US008151751B2

(12) United States Patent
Shiino et al.

(10) Patent No.: US 8,151,751 B2
(45) Date of Patent: Apr. 10, 2012

(54) PHASE VARYING APPARATUS FOR ENGINE

(75) Inventors: Minoru Shiino, Kanagawa (JP); Koichi Honma, Kanagawa (JP)

(73) Assignee: Nittan Valve Co., Ltd., Kanagawa (JP)

( * ) Notice: Subject to any disclaimer, the term of this patent is extended or adjusted under 35 U.S.C. 154(b) by 594 days.

(21) Appl. No.: 12/373,283

(22) PCT Filed: Aug. 3, 2006

(86) PCT No.: PCT/JP2006/315386

§ 371 (c)(1),
(2), (4) Date: Jan. 9, 2009

(87) PCT Pub. No.: WO2008/015746

PCT Pub. Date: Feb. 7, 2008

(65) Prior Publication Data

US 2009/0183704 A1 Jul. 23, 2009

(30) Foreign Application Priority Data

Jul. 31, 2006 (JP) ..... 2006-208665

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS

| | | | | |
|---|---|---|---|---|
| 6,805,081 | B2 * | 10/2004 | Watanabe et al. | 123/90.17 |
| 2005/0045127 | A1 * | 3/2005 | Aino et al. | 123/90.17 |

FOREIGN PATENT DOCUMENTS

| | | | |
|---|---|---|---|
| JP | 4-330307 | A | 11/1992 |
| JP | 2003-172111 | A | 6/2003 |
| JP | 2004-11537 | A | 1/2004 |
| JP | 2005-180398 | A | 7/2005 |
| JP | 2005-299604 | A | 10/2005 |
| JP | 2005-299606 | A | 10/2005 |

OTHER PUBLICATIONS

International Search Report for PCT/JP2006/315386 mailed Sep. 19, 2006.

International Preliminary Report on Patentability and Written Opinion for for International Application No. PCTJP2006/315386.

* cited by examiner

*Primary Examiner* — Zelalem Eshete

(74) *Attorney, Agent, or Firm* — Roberts Mlotkowski Safran & Cole, P.C.; Thomas W. Cole

(57) ABSTRACT

[Object]

To keep an air-gap between an electromagnetic clutch and a magnet within a predetermined range even if a camshaft vibrates in a radial direction.

[Achieving Means]

A bearing 26 and a stopper 51 are attached to a stepped part 20*c* of an inner cylinder part 20, the bearing 26 is supported by a C ring 28 inserted in a groove 44*c* of a rotational drum 44, a bearing 52 is attached to a stepped part 51*a* formed on the side of the outer periphery of the stopper 51, an inner sidewall 122*c* of an electromagnetic clutch 42 is supported by the bearing 52, the bearing 52 is supported by a clip 128 attached to an annular groove 127 formed in the inner sidewall 122*c*, the rotational drum 44 is supported by the bearing 26 prevented from moving in an axial direction, the electromagnetic clutch 42 is supported by the bearing 52 prevented from moving in the axial direction, and an air-gap AG between the electromagnetic clutch 42 and the magnet 45 of the rotational drum 44 is easily managed.

4 Claims, 16 Drawing Sheets

PHASE VARYING APPARATUS FOR ENGINE

TECHNICAL FIELD

This invention relates to a phase varying apparatus for use with an engine that varies the rotational phase of a camshaft relative to a crankshaft and varies a valve opening/closing timing by allowing an electromagnetic clutch to apply a thrust force onto a rotational drum, and, more particularly, to an improvement in the installation structure of an electromagnetic clutch that applies a thrust force onto a rotational drum of a phase varying apparatus.

BACKGROUND ART

A phase varying apparatus for use with an engine is structured to controllably vary the opening/closing timing of an intake-side or exhaust-side open-close valve of the engine in accordance with an operational state. For example, a valve timing control apparatus has been proposed as this kind of phase varying apparatus. This valve timing control apparatus is made up of a rotational member to which a rotational force is transmitted from a crankshaft, a camshaft formed integrally with a cam by which an engine valve is opened and closed, a phase adjusting mechanism that is disposed between the rotational member and the camshaft and that adjusts a relative rotational phase of the camshaft relative to the rotational member by receiving an electromagnetic force, an internally hollow cylindrical member that is disposed on the side of the rotational member or on the side of the camshaft and that is extended in the axial direction, an electromagnetic generation portion that is rotatably borne by the cylindrical member and that applies an electromagnetic force onto the phase adjusting mechanism, and a backlash absorbing mechanism that absorbs the backlash or play of the electromagnetic generation portion (see Patent Literature 1). In this valve timing control apparatus, the electromagnetic generation portion is borne by the cylindrical member, and a space is formed inside the cylindrical member, and hence the entire apparatus can be lightened. Additionally, the electromagnetic generation portion is supported by a cover through the backlash absorbing mechanism including an elastic body, and hence, even if a force in the axial direction is applied to the electromagnetic generation portion from the camshaft side so that the electromagnetic generation portion is displaced in the axial direction, the backlash or play of the electromagnetic generation portion caused by this displacement can be absorbed by the backlash absorbing mechanism.

Patent Literature 1: Japanese Published Unexamined Patent Application No. 2005-299604 (see pages 4 to 8, FIG. 1.)

DISCLOSURE OF INVENTION

Problems to be Solved by the Invention

In the apparatus disclosed by Patent Literature 1, although the backlash or play caused by the displacement of the electromagnetic generation portion in the axial direction of the camshaft can be absorbed, the backlash or play caused by the displacement of the electromagnetic generation portion in the radial direction of the camshaft cannot be sufficiently absorbed, and hence there is a fear that an electromagnetic force generated from the electromagnetic generation portion cannot be stably controlled at any time when the camshaft vibrates in the radial direction thereof.

The present invention has been made in consideration of this problem of the prior art apparatus. It is therefore an object of the present invention to keep a gap between an electromagnetic clutch and a magnet within a predetermined range even if a camshaft vibrates in its radial direction.

Means for Solving the Problems

To solve the problem, the phase varying apparatus for use with an engine according to a first aspect of the present invention comprises an outer cylinder part to which rotations of a crankshaft of the engine are transmitted; an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner; relative rotations being generated between the outer cylinder part and the inner cylinder part by moving the intermediate member in an axial direction, thereby changing an opening/closing timing of the intake valve or the exhaust valve, in which the improvement comprises a rotational drum screwed to the intermediate member; a plurality of magnets fixed to the rotational drum with predetermined intervals in a circumferential direction of the rotational drum; an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine, in which a first bearing and a stopper arranged in parallel with each other are fixed to an outer periphery of the inner cylinder part, in which the rotational drum is rotatably supported by the first bearing, in which a second bearing fixed to an outer periphery of the stopper is connected to the electromagnetic clutch, and in which the electromagnetic clutch is attached to a cover, and is supported by the cover in a rotationally stopped manner.

(Operation) The rotational drum is rotatably supported by the inner cylinder part connected to the camshaft through the first bearing, and the electromagnetic clutch is connected to the inner cylinder part through the second bearing and the stopper, and is supported by the cover in a rotationally stopped manner. Therefore, even if the camshaft vibrates in accordance with the operation of the engine so that the vibrations of the camshaft are transmitted to the inner cylinder part and so that the rotational drum and the electromagnetic clutch start moving in the radial direction of the camshaft, the movements of the rotational drum and the electromagnetic clutch in the radial direction of the camshaft are prevented by the rotations of the first bearing and the second bearing. Therefore, an air-gap between the electromagnetic clutch and the magnet can be kept within a predetermined range, and an electromagnetic force generated from the electromagnetic clutch can be controlled stably at any time.

The phase varying apparatus for use with an engine according to a second aspect of the present invention comprises an outer cylinder part to which rotations of a crankshaft of the engine are transmitted; an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner; relative rotations being generated between the outer cylinder part and the inner cylinder part by moving the intermediate member in an axial direction, thereby changing an opening/closing timing of the intake valve or the exhaust valve, in which the improvement comprises a rotational drum screwed to the intermediate member; a plurality of magnets fixed to the rotational drum with predetermined intervals in a circumferential direction of the rotational drum; an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine, in which a first bearing is fixed to an outer periphery of the inner cylinder part, in which the rotational drum is rotatably supported by the first bearing, in which a second bearing disposed between the electromagnetic clutch and the rotational drum for preventing the electromagnetic clutch from moving in an axial direction of the inner cylinder part is attached to an outer periphery of the rotational drum, in which the second bearing is attached to the electromagnetic clutch and is supported by the electromagnetic clutch in a rotationally stopped manner, and in which the electromagnetic clutch is attached to a cover and is supported by the cover in a rotationally stopped manner.

(Operation) The rotational drum is rotatably supported by the inner cylinder part connected to the camshaft through the first bearing, and the electromagnetic clutch is connected to the rotational drum through the second bearing, and is supported by the cover in a rotationally stopped manner. Therefore, when the camshaft vibrates in accordance with the operation of the engine, and when vibrations of the camshaft are transmitted to the inner cylinder part so that the rotational drum and the electromagnetic clutch move in the radial direction of the camshaft, vibrations in the radial direction of the rotational drum are transmitted to the electromagnetic clutch through the second bearing as vibrations generated in the same direction. Therefore, an air-gap between the electromagnetic clutch and the magnet can be kept within a predetermined range, and an electromagnetic force generated from the electromagnetic clutch can be controlled stably at any time.

The phase varying apparatus for use with an engine according to a third aspect of the present invention comprises an outer cylinder part to which rotations of a crankshaft of the engine are transmitted; an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner; relative rotations being generated between the outer cylinder part and the inner cylinder part by moving the intermediate member in an axial direction, thereby changing an opening/closing timing of the intake valve or the exhaust valve, in which the improvement comprises a rotational drum screwed to the intermediate member; a plurality of magnets fixed to the rotational drum with predetermined intervals in a circumferential direction of the rotational drum; an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine, in which a first bearing is fixed to an outer periphery of the inner cylinder part, in which the rotational drum is rotatably supported by the first bearing, in which an annular boss with which the intermediate member is covered is connected to the outer cylinder part, in which the annular boss is connected to the electromagnetic clutch through a second bearing, and in which the electromagnetic clutch is attached to a cover, and is supported by the cover in a rotationally stopped manner.

(Operation) The rotational drum is rotatably supported by the inner cylinder part connected to the camshaft through the first bearing, and the electromagnetic clutch is connected to the outer cylinder part, which is connected to the camshaft and rotates relative to the inner cylinder part, through the second bearing, and is supported by the cover in a rotationally stopped manner. Therefore, when the camshaft vibrates in accordance with the operation of the engine, and when vibrations of the camshaft are transmitted to the inner cylinder part and to the outer cylinder part so that the rotational drum and the electromagnetic clutch move in the radial direction of the camshaft, vibrations in the radial direction of the camshaft are transmitted to the rotational drum through the first bearing and to the electromagnetic clutch through the second bearing as vibrations generated in the same direction. Therefore, an air-gap between the electromagnetic clutch and the magnet can be kept within a predetermined range, and an electromagnetic force generated from the electromagnetic clutch can be controlled stably at any time.

The phase varying apparatus for use with an engine according to a fourth aspect of the present invention comprises an outer cylinder part to which rotations of a crankshaft of the engine are transmitted; an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner; relative rotations being generated between the outer cylinder part and the inner cylinder part by moving the intermediate member in an axial direction, thereby changing an opening/closing timing of the intake valve or the exhaust valve, in which the improvement comprises a rotational drum screwed to the intermediate member; a plurality of magnets fixed to the rotational drum with predetermined intervals in a circumferential direction of the rotational drum; an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine, in which a first bearing and a second bearing arranged in parallel with each other are fixed to an outer periphery of the inner cylinder part, in which the rotational drum is rotatably supported by the first bearing, in which the second bearing is held by a cover with which the electromagnetic clutch is covered, and in which the electromagnetic clutch is attached to the cover, and is supported by the cover in a rotationally stopped manner.

(Operation) The rotational drum is rotatably supported by the inner cylinder part connected to the camshaft through the first bearing, and the inner cylinder part connected to the camshaft is fixed to the cover through the second bearing, and the electromagnetic clutch is supported by the cover in a rotationally stopped manner. Therefore, even if the camshaft vibrates in accordance with the operation of the engine, and even if vibrations of the camshaft are transmitted to the inner cylinder part so that the rotational drum and the electromagnetic clutch move in the radial direction of the camshaft, the vibrations in the radial direction of the camshaft are absorbed by the second bearing. Therefore, an air-gap between the electromagnetic clutch and the magnet can be kept within a predetermined range, and an electromagnetic force generated from the electromagnetic clutch can be controlled stably at any time.

The phase varying apparatus for use with an engine according to a fifth aspect of the present invention comprises an outer cylinder part to which rotations of a crankshaft of the engine are transmitted; an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner; relative rotations are generated between the outer cylinder part and the inner cylinder part by moving the intermediate member in an axial direction, thereby changing an opening/closing timing of the intake valve or the exhaust valve, in which the improvement comprises a rotational drum screwed to the intermediate member; a plurality of magnets fixed to the rotational drum with predetermined intervals in a circumferential direction of the rotational drum; an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine, in which a first bearing is fixed to an outer periphery of the inner cylinder part, in which the rotational drum is rotatably supported by the first bearing, in which a second bearing disposed between the electromagnetic clutch and the rotational drum for preventing the electromagnetic clutch from moving in an axial direction of the inner cylinder part of the electromagnetic clutch is attached to an outer periphery of the rotational drum, wherein the second bearing is attached to the electromagnetic clutch, and is supported by the electromagnetic clutch in a rotationally stopped manner, and in which the electromagnetic clutch is attached to a boss of an engine head, and is supported by the boss in a rotationally stopped manner.

(Operation) The rotational drum is rotatably supported by the inner cylinder part connected to the camshaft through the first bearing, and the electromagnetic clutch is connected to the rotational drum through the second bearing, and is supported by the boss of the engine head in a rotationally stopped manner. Therefore, when the camshaft vibrates in accordance with the operation of the engine, and when vibrations of the camshaft are transmitted to the inner cylinder part so that the rotational drum and the electromagnetic clutch move in the radial direction of the camshaft, vibrations in the radial direction of the rotational drum are transmitted to the electromagnetic clutch through the second bearing as vibrations generated in the same direction. Therefore, an air-gap between the electromagnetic clutch and the magnet can be kept within a predetermined range, and an electromagnetic force generated from the electromagnetic clutch can be controlled stably at any time.

The phase varying apparatus for use with an engine according to a sixth aspect of the present invention is structured so that, in the phase varying apparatus for use with an engine according to the second or fourth aspect of the present invention, a boss is formed on the cover with which the electromagnetic clutch is covered; a first annular groove is formed in an outer circumferential surface of the boss of the cover; an elastic body at least a part of which protrudes from the first annular groove and which has elasticity in a circumferential direction of the first annular groove is fitted to the first annular groove; a second annular groove facing the first annular groove is formed in a surface of the electromagnetic clutch facing the boss; and the electromagnetic clutch attached to the boss of the cover is prevented from moving in a direction perpendicular to a radial direction of the boss owing to contact with the elastic body disposed over the first annular groove and the second annular groove.

(Operation) To attach the electromagnetic clutch to the boss of the cover, the cover is placed while directing the boss toward the upper surface, and the elastic body is fitted to the first annular groove formed in the outer circumferential surface of the boss of the cover, As a result, the elastic body is fitted to the first annular groove in a state in which at least a part thereof protrudes from the first annular groove. In this state, it is inserted while pressing the inner sidewall of the electromagnetic clutch against the boss of the cover. Accordingly, in accordance with the movement of the electromagnetic clutch, the part of the elastic body protruding from the first annular groove undergoes elastic deformation in the circumferential direction of the first annular groove, and is housed in the first annular groove. Thereafter, when the second annular groove formed in the electromagnetic clutch occupies a position that faces the first annular groove of the boss, the part of the elastic body housed in the first annular groove again protrudes from the first annular groove, and is inserted into the second annular groove, and the elastic body is disposed ranging from the first annular groove to the second annular groove. When the electromagnetic clutch is attached to the boss of the cover in this state, the electromagnetic clutch is prevented from moving in the direction perpendicular to the radial direction of the boss owing to contact with the elastic body disposed over the first annular groove of the boss and the second annular groove of the electromagnetic clutch. Therefore, even if the electromagnetic clutch is directed toward the lower surface, the electromagnetic clutch can be prevented from dropping off from the cover, and this can contribute to an improvement in workability.

EFFECTS OF THE INVENTION

As is apparent from the description given above, with the phase varying apparatus for use with an engine according to the first aspect of the present invention, an air-gap between the electromagnetic clutch and the magnet can be kept within a predetermined range, and an electromagnetic force generated from the electromagnetic clutch can be controlled stably at any time.

With the phase varying apparatus for use with an engine according to the second aspect of the present invention, an air-gap between the electromagnetic clutch and the magnet can be kept within a predetermined range, and an electromagnetic force generated from the electromagnetic clutch can be controlled stably at any time.

With the phase varying apparatus for use with an engine according to the third aspect of the present invention, an air-gap between the electromagnetic clutch and the magnet can be kept within a predetermined range, and an electromagnetic force generated from the electromagnetic clutch can be controlled stably at any time.

With the phase varying apparatus for use with an engine according to the fourth aspect of the present invention, an air-gap between the electromagnetic clutch and the magnet can be kept within a predetermined range, and an electromagnetic force generated from the electromagnetic clutch can be controlled stably at any time.

With the phase varying apparatus for use with an engine according to the fifth aspect of the present invention, an air-gap between the electromagnetic clutch and the magnet can be kept within a predetermined range, and an electromagnetic force generated from the electromagnetic clutch can be controlled stably at any time.

With the phase varying apparatus for use with an engine according to the sixth aspect of the present invention, even if the electromagnetic clutch is directed toward the lower surface, the electromagnetic clutch can be prevented from dropping off from the cover, and this can contribute to an improvement in workability.

BEST MODE FOR CARRYING OUT THE INVENTION

Embodiments of a phase varying apparatus for use with an engine according to the present invention will be hereinafter described with reference to the attached drawings. FIG. 1 is a longitudinal sectional view illustrating a basic structure of the phase varying apparatus for use with an engine according to the present invention, FIG. 2 is a perspective view of an electromagnetic clutch, FIG. 3 is a schematic view illustrating the relationship between the electromagnetic clutch and a magnet, FIG. 4 explains a principle by which a rotational drum of the phase varying apparatus is accelerated and decelerated, FIG. 5 is a block diagram of a control circuit of the electromagnetic clutch in the phase varying apparatus, FIG. 6 is a wiring diagram of a coil drive circuit and each coil in the phase varying apparatus, FIG. 7 is a flow chart for explaining the operation of the phase varying apparatus, FIG. 8 is a longitudinal sectional view of a main part of a cover to which a spring clip has been attached, FIG. 9 is a sectional view along the line A-A of FIG. 8, FIG. 10 is an enlarged side sectional view of a main part of a boss of the cover to which the electromagnetic clutch has been attached, FIG. 11 is a longitudinal sectional view illustrating a first embodiment of the phase varying apparatus for use with an engine according to the present invention, FIG. 12 is a view for explaining an air-gap AG formed between the electromagnetic clutch and the magnet, FIG. 13 is a longitudinal sectional view illustrating a second embodiment of the phase varying apparatus for use with an engine according to the present invention, FIG. 14 is a sectional view for explaining the relationship between the electromagnetic clutch and a sliding bearing, FIG. 15 is a longitudinal sectional view illustrating a third embodiment of the phase varying apparatus for use with an engine according to the present invention, FIG. 16 is a longitudinal sectional view illustrating a fourth embodiment of the phase varying apparatus for use with an engine according to the present invention, FIG. 17 is an exploded perspective view of the electromagnetic clutch and the cover illustrating a fifth embodiment of the phase varying apparatus for use with an engine according to the present invention, FIG. 18 is an exploded perspective view of the electromagnetic clutch and the cover illustrating a sixth embodiment of the phase varying apparatus for use with an engine according to the present invention, FIG. 19 is a longitudinal sectional view illustrating a seventh embodiment of the phase varying apparatus for use with an engine according to the present invention, FIG. 20 is a front view illustrating an embodiment of a multicoil electromagnetic clutch, FIG. 21 is a front view illustrating an embodiment of a rotational drum used in the multicoil electromagnetic clutch, and FIG. 22 is a perspective view illustrating an embodiment of the electromagnetic clutch having a pin used for a rotation-stop in the axial direction.

In these drawings, the phase varying apparatus for use with an engine according to the present invention is used in the state of being fitted integrally with the engine under an engine oil atmosphere. The phase varying apparatus transmits the rotation of the crankshaft to the camshaft so as to open and close the intake and exhaust valves of the engine in synchronization with the rotation of the crankshaft, and varies a timing at which the intake and exhaust valves are opened and closed in accordance with the operational state of the engine, such as the load or the number of revolutions of the engine. As shown in FIG. 1, the phase varying apparatus is made up of an annular outer cylinder part 10 that is a sprocket to which the driving force of the crankshaft of the engine is transmitted, an annular inner cylinder part 20 that is disposed coaxially with the outer cylinder part 10 so as to be relatively rotatable with respect to the outer cylinder part 10 and that forms a part of the camshaft 2 on the driven side, an intermediate member 30 that is interposed between the outer cylinder part 10 and the inner cylinder part 20 in the state of being engaged with the outer cylinder part 10 and with the inner cylinder part 20 in a helical spline manner and that varies the phase of the inner cylinder part 20 relative to the outer cylinder part 10 by moving in the axial direction of the camshaft 2, and an electromagnetic clutch 42 that is disposed on the side on which the camshaft 2 of the inner cylinder part 20 is not disposed and that moves the intermediate member 30 in the axial direction, A cover 8 is attached to the electromagnetic clutch 42. The camshaft 2 is provided with a cam (not shown) used to open and close either the intake valve or the exhaust valve.

The outer cylinder part 10 consists of a sprocket body 12 and a spline case 16. The sprocket body 12 has a ring-like concave part 13 formed on its inner peripheral edge. The spline case 16 formed in the shape of an annular body surrounding the intermediate member 30 is fitted to the concave part 13, and has a spline engagement part, which is engaged with the intermediate member 30, on its inner periphery. The rotation of the crankshaft of the engine is transmitted to the outer cylinder part 10 (to the sprocket body 12) through a chain C. The spline case 16 is fixed to a flange part 12*a* of the sprocket body 12 by means of a bolt 14. An auxiliary outer cylinder part 11 surrounding the annular inner cylinder part 20 is fixed to the flange part 12*a* by means of a bolt 15.

The annular inner cylinder part 20 is made up of a flange part 20*a*, a stepped part 20*b*, and a stepped part 20*c* smaller in diameter than the stepped part 20*b*. The annular inner cylinder part 20 on the side of the flange part 20*a* is connected to the camshaft 2, whereas a cam bolt 19 serving as a fastener member fastened to the camshaft 2 by being passed through the inside of the annular inner cylinder part 20 is fixed to the annular inner cylinder part 20 on the side of the stepped part 20*c*. The intermediate member 30 is attached to the outer circumferential surface of the stepped part 20*b*. A bearing 26 and an annular stopper 27 are attached to the outer circumferential surface of the stepped part 20*c*. A male helical spline 23 engaged with the spline 32 formed on the inner circumferential surface of the intermediate member 30 is formed on the outer circumferential surface of the stepped part 20*b*. A spline 33 engaged with a female helical spline 17 formed on the inner circumferential surface of the spline case 16 is formed on the outer circumferential surface of the intermediate member 30. The splines 32 and 33 formed inside and outside the intermediate member 30, respectively, are opposite-direction helical splines. A slight movement of the intermediate member 30 in the axial direction makes it possible to greatly vary the phase of the inner cylinder part 20 relative to the outer cylinder part 10. A male square thread part 31 is formed on the outer circumferential surface of the intermediate member 30.

The bearing 26 is disposed between the wall surface of the stepped part 20*b* and the stopper 27. A fastening force from the cam bolt 19 acts on the bearing 26 through the stopper 27. In more detail, the bearing 26 is attached to the stepped part 20*c*, and is fixed to the outer circumferential surface of the stepped part 20*b* in the state of being restricted in a movement toward the camshaft 2 by contact with the wall surface of the stepped part 20*b* and in the state of being restricted in a movement toward a head 19*a* of the cam bolt 19 by contact with the stopper 27 supported by the head 19*a* of the cam bolt 19 and contact with a C ring (washer) 28 supported by a rotational drum 44. As a result, the rotational drum 44 is supported in a floating manner.

The rotational drum 44 is formed as an annular body surrounding the intermediate member 30, and a magnet (permanent magnet) 45 is fixed to a surface of the rotational drum 44 that faces the electromagnetic clutch 42. The rotational drum 44 is rotatably supported by the inner cylinder part 20 with the bearing 26 therebetween, and is rotatably screwed to the intermediate member 30.

The electromagnetic clutch 42 is disposed close to the outer side-surface of the rotational drum 44 as shown in FIG. 1, and consists of a ring-like iron core 122 and a coil 120 wound in a groove 124 of the iron core 122 as shown in FIG. 2. The ring-like iron core 122 has a cross section formed in the shape of a groove, and consists of a bottom 122*a* and a pair of sidewalls 122*b* and 122*c*. The opening of the groove 124 is directed toward the rotational drum 44. A plurality of outer magnetized pieces 126*a* and a plurality of inner magnetized pieces 126*b* are projected from the outer sidewall 122*b* and the inner sidewall 122*c* of the iron core 122, respectively, with equal intervals or different intervals. The outer magnetized piece 126*a* and the inner magnetized piece 126*b* are disposed to face each other in the same radial direction. When the coil 120 is energized, the outer magnetized piece 126*a* and the inner magnetized piece 126*b* are magnetized to have magnetic poles N and S differing from each other. When the direction of the electric current supplied to the coil 120 is reversed, the outer and inner magnetized pieces 126*a* and 126*b* are reversed in their magnetic poles.

On the other hand, the rotational drum 44 has a flange part 44*a* and a stepped part 44*b*. A female screw part 46 that is screwed to a male screw part 31 of the intermediate member 30 is formed on the inner periphery of a cylindrical part 44*d* of the rotational drum 44. When the rotational drum 44 makes relative rotations with respect to the outer cylinder part 10, the intermediate member 30 is moved in the axial direction by the action of both of the screw parts 46 and 31. The bearing 26 is attached to the stepped part 44*b* of the rotational drum 44, and an annular groove 44*c* is formed in the stepped part 44*b* thereof. A C ring 28 is fitted in the groove 44*c*. As shown in FIG. 3, a plurality of magnets 45 are fixed to the rotational drum 44 with equal intervals or different intervals in the circumferential direction. The magnet 45 provided on the rotational drum 44 is disposed between the inner and outer magnetized pieces 126*b* and 126*a* provided on the iron core 122 of the electromagnetic clutch 42. The front 45*b* of each magnetic pole 45*a* of the magnet 45 and each of the magnetized pieces 126*a* and 126*b* are allowed to face each other as close to each other as possible so that a strong magnetic force acts therebetween. Each magnet 45 is magnetized in the radial direction of the rotational drum 44. The front 45*b* of the magnetic pole 45*a* (N pole or S pole) of each magnet 45 is directed toward the outside and toward the center in the radial direction of the rotational drum 44. In this state, one of the magnets 45 is magnetized in the direction opposite to the magnetized direction of another adjoining magnet 45.

The rotational drum 44 rotates together with the outer cylinder part 10, the inner cylinder part 20, and the intermediate member 30 when the coil 120 is in a non-energized state, when the electromagnetic clutch 42 is in an OFF state, and when a thrust force does not act as the force of acceleration and deceleration. In other words, a constant air-gap is formed between the rotational drum 44 and the electromagnetic clutch 42 when the electromagnetic clutch 42 is in an OFF state, and the rotational drum 44 rotates together with the outer cylinder part 10, the inner cylinder part 20, and the intermediate member 30 when there is no phase difference between the outer cylinder part 10 and the inner cylinder part 20. On the other hand, when the electromagnetic clutch 42 is turned on by energizing the coil 120, an electromagnetic force from the electromagnetic clutch 42 acts on the rotational drum 44 as a thrust force. Therefore, the intermediate member 30 screwed to the rotational drum 44 moves in the axial direction in accordance with an electromagnetic force while rotating along the screw parts 46 and 31. As a result, the phase of the outer cylinder part 10 and the phase of the inner cylinder part 20 are varied, so that a valve opening/closing timing by means of the cam of the camshaft 2 can be adjusted.

Next, a principle by which the rotational drum 44 is accelerated and decelerated will be described with reference to FIG. 4. Note that, in the following description, to make it easy to understand the positional relationship between the magnet 45 of the rotational drum 44 and the magnetized pieces 126*a* and 126*b* of the electromagnetic clutch 42, the rotational drum 44 and the electromagnetic clutch 42 are planarly developed at the position of the magnet 45 and at the positions of the magnetized pieces 126*a* and 126*b* in FIG. 4. Herein, the rotational direction of the rotational drum 44 is assumed as a rightward direction. Additionally, this rightward direction is assumed as being on a front side, and a leftward direction opposite to the rightward direction is assumed as being on a rear side. Still additionally, a magnetic sensor 108 is disposed near the forward end of one of the magnetized pieces 126*a* and 126*b* (for example, the first one) facing each other. For example, a sensor in which an H signal (+1) is output when one magnetic pole N (or magnetic pole S) approaches the magnetized piece whereas an L signal (O) is output when the other magnetic pole S (or magnetic pole N) approaches the magnetized piece is used as the magnetic sensor 108. A hall element is used as this type of magnetic sensor 108. Of course, another magnetic sensor, such as a search coil, can be appropriately used. First, a case in which the rotational drum 44 is accelerated will be described. As shown in (A) of FIG. 4, it is understood that either magnetic pole N or S is closest to the magnetic sensor 108 by a change in a magnetic-pole signal c emitted from the magnetic sensor 108 at time T1. Accordingly, the positional relationship between the magnetic poles 45*a* of all magnets 45 and all magnetized pieces 126*a* and 126*b* is understood because the magnets 45 and the magnetized pieces 126*a* and 126*b* are disposed with predetermined intervals. The rotational drum 44 rotates to the position shown by (B) of FIG. 4 at time T2 immediately after time T1. To accelerate the rotational drum 44 at this time, the coil 120 is energized so that the magnetized piece 126*a* on the side on which the magnetic sensor 108 is disposed has the same magnetic pole as the magnetic pole detected by the magnetic sensor 108 from time T1 and so that the magnetized piece 126*b* disposed on the opposite side has a reverse magnetic pole opposite to the magnetic pole detected by the magnetic sensor 108. The rotational drum 44 rotates to the position shown by (C) of FIG. 4 at time T3, and a magnetic-pole signal c emitted from the magnetic sensor 108 is reversed. At time T4 immediately after time T3, the rotational drum 44 rotates to the position shown by (D) of FIG. 4. To accelerate the rotational drum 44 at this time, the polarity of the electric current supplied to the coil 120 is reversed so that the magnetized piece 126*a* on the side on which the magnetic sensor 108 is disposed has the same magnetic pole as the magnetic pole detected by the magnetic sensor 108 from time T3 and so that the magnetized piece 126*b* on the opposite side has a reverse magnetic pole opposite to the magnetic pole detected by the magnetic sensor 108.

Whenever the polarity detected with a magnetic-pole signal c emitted from the magnetic sensor 108 is reversed, the direction of the electric current applied to the coil 120 is reversed in the same way as above, and the magnetized piece 126*a* on the side on which the magnetic sensor 108 is disposed is allowed to have the same magnetic pole as the magnetic pole detected by the magnetic sensor 108, whereas the magnetized piece 126*b* on the opposite side is allowed to have a reverse magnetic pole opposite to the magnetic pole detected by the magnetic sensor 108, thus making it possible to continuously accelerate the rotational drum 44. When there is no need to accelerate and decelerate the rotational drum 44, an electric current supplied to the coil 120 is stopped. Accordingly, the rotational drum 44 can maintain the phase. What is required to decelerate the rotational drum 44 is to supply the coil 120 with an electric current having a flow direction opposite to that of an electric current used when the rotational drum 44 is accelerated. Another possible way to decelerate the rotational drum 44 is to appropriately pass a counter-electromotive force generated in the coil 120 through a resistor or a battery so that the electromagnetic clutch 42 serves as an electric brake or a regenerative brake.

One example of a control circuit 100 is shown in FIG. 5. The control circuit 100 that controls an electric current supplied to the coil 120 of the electromagnetic clutch 42 is made up of a controller (microcomputer) 102 serving as an electromagnetic force control means that controls an electromagnetic force generated from the electromagnetic clutch 42 in accordance with the operational state of the engine, a coil drive circuit 104, a variable voltage power source 106, and the magnetic sensor 108. Based on a crank angle signal "a" and a cam angle signal b, which are transmitted from the engine 110, and a magnetic-pole signal c transmitted from the magnetic sensor 108, the controller 102 sends a driving signal d used to controllably accelerate or decelerate the rotational drum 44 to the coil drive circuit 104 so that a deviation from a set value of a phase angle of a cam angle relative to a crank angle disappears, i.e., so that a phase deviation disappears. What is required to stop the acceleration and deceleration of the rotational drum 44 is to stop the driving signal d. Additionally, the controller 102 sends a power source control signal e used to change a voltage applied to the coil 120 in accordance with an absolute value of the phase deviation to the variable voltage power source 106 so that phase control can be more finely performed.

The coil drive circuit 104 is a semiconductor switch circuit that turns an electric current to be supplied to the coil 120 on and off and that changes the direction of the electric current in accordance with a driving signal d transmitted from the controller 102. The driving signal d includes an H1 signal and an H2 signal used to turn a switching transistor 80 on and off. An H (high electric potential) signal or an L (low electric potential) signal is output as the H1 signal or the H2 signal. The variable voltage power source 106 raises or lowers an output voltage in accordance with a power source control signal e transmitted from the controller 102, and sends the resulting voltage to the coil drive circuit 104. In this embodiment, when the absolute value of the phase deviation is low, the output voltage is lowered by performing pulse-width modulation (PWM) in accordance with the power source control signal e. On the other hand, when the absolute value of the phase deviation is high, the output voltage of the variable voltage power source 106 is appropriately raised by a voltage raising means so as to supply a sufficient electric current to the coil 120.

FIG. 6 shows one example of a wiring diagram of the coil drive circuit 104 and the coil 120. The coil drive circuit 104 is a bridge circuit consisting of four switching transistors 80 and the coil 120. A diode 84 inserted in the switching transistor 80 in parallel is used to prevent a counter-electromotive force generated in the coil 120 from being applied onto the switching transistor 80.

An H1 signal and an H2 signal that are signals included in a driving signal d and that turn the switching transistor 80 on and off are transmitted from the controller 102. If the H1 signal is an H signal (H1=1), and the H2 signal is an L signal (H2=0), an electric current flows through the coil 120 in the rightward direction, and the magnetized pieces 126*a* and 126*b* can be magnetized. If the H1 signal is reversed to an L signal (H1=0), and the H2 signal is reversed to an H signal (H2=1) here, an electric current flows through the coil 120 in the leftward direction, and the polarities of the magnetized pieces 126*a* and 126*b* can be reversed. An H1 signal or an H2 signal is transmitted from the controller 102 to the coil drive circuit 104 in this way, and the direction of an electric current to be supplied to the coil 120 is controlled, and, as a result, both of the magnetized pieces 126*a* and 126*b* are allowed to have proper magnetic poles. Therefore, the rotational drum 44 can be controllably accelerated and decelerated.

Next, the control process of the controller 102 will be described with reference to FIG. 7. To control the acceleration and deceleration of the rotational drum 44, the phase varying apparatus starts operating. First, the process proceeds to step S1, where it is determined from a crank angle signal "a" and a cam angle signal b transmitted from the engine 110 whether the absolute value of a deviation from the set value of a phase angle of a cam angle relative to a crank angle, i.e., the absolute value of a phase deviation is a predetermined value K1 or more. If the absolute value of the phase deviation is less than the predetermined value K1, there is no need to control the acceleration and deceleration of the rotational drum 44, and hence the process proceeds to step S2. At step S2, the output of a driving signal d to the coil drive circuit 104 is stopped (H1=0, H2=0), and the supply of an electric current to the coil 120 is stopped so as to bring the magnetized pieces 126*a* and 126*b* into a non-excitation state. Thereafter, the process returns to step S1.

If the absolute value of the phase deviation is the predetermined value K1 or more at step S1, there is a need to control the acceleration and deceleration of the rotational drum 44, and hence the process proceeds to step S3 where it is determined from the positive or negative of the phase deviation whether to accelerate or decelerate the rotational drum 44. For example, if the phase deviation is negative, it is determined that the rotational drum 44 is decelerated, and steps S4 to S6 are performed. However, depending on the direction of the helical splines 32 and 33 disposed inside and outside the intermediate member 30, the rotational drum 44 is accelerated without being decelerated.

At step S4, a magnetic-pole signal c transmitted from the magnetic sensor 108 is examined, and it is detected whether the magnet 45 closest to the magnetic sensor 108 is the N pole or the S pole, and, as a result, a driving signal d (H1 signal and H2 signal) indicating the direction in which an electric current is passed through the coil 120 is determined.

Thereafter, the process proceeds to step S5 where a power source control signal e is determined from the absolute value of the phase deviation. If the absolute value of the phase deviation is a predetermined value K2 or more (K2>K1), the variable voltage power source 106 makes its output voltage greater than the power supply (battery) voltage in accordance with the absolute value of the phase deviation, whereas the variable voltage power source 106 makes its output voltage smaller than the power supply voltage in accordance with the absolute value of the phase deviation if the absolute value of the phase deviation is less than the predetermined value K2.

Thereafter, the process proceeds to step S6 where a power source control signal e is transmitted to the variable voltage power source 106, and a driving signal d is transmitted to the coil drive circuit 104 so as to pass an electric current through the coil 120 of the electromagnetic clutch 42. Thereafter, the process returns to step S1. Steps S1, S3, S4, S5, and S6 are repeatedly performed in this way, and the rotational drum 44 is decelerated. Until the absolute value of the phase deviation falls within the predetermined value K1, the phase deviation is continuously made small.

If the phase deviation is positive, and it is determined that the rotational drum 44 is accelerated at step S3, steps S7 to S9 are performed. At step S7, to accelerate the rotational drum 44, an H1 signal and an H2 signal both of which are included in a driving signal d are in a reversed state opposite to the state at step S4 although the driving signal d is determined in the same way as at step S4. Steps S8 and S9 are the same as steps S5 and S6 mentioned above. After all, if steps S7 to S9 are performed, the direction of an electric current to be passed through the coil 120 becomes opposite to the direction given when steps S4 to S6 are performed. Thereafter, the process returns to step S1, and then steps S1, S3, S7, S8, and S9 are repeatedly performed. Until the absolute value of the phase deviation falls within the predetermined value K1, the phase deviation is continuously made small by accelerating the rotational drum 44.

As mentioned above, in this phase varying apparatus, the phase deviation can be kept within the predetermined value K1 at any time by performing steps S1 to S9.

Additionally, the electromagnetic clutch 42 is attached to the boss 8*a* of the cover 8, and a pin 68 fixed to the outer sidewall 122*b* is inserted into a guide groove 8*b* of the cover 8, so that a movement in the circumferential direction thereof is stopped by the engagement between the pin 68 and the guide groove 8*b*. As shown in FIG. 8, a first annular groove 8*d* is formed in an outer circumferential surface 8*c* of the annular boss 8*a* of the cover 8. For example, a spring clip 90, at least a part of which protrudes from the first annular groove 8*d* and which serves as a rectangular elastic body having elasticity in the circumferential direction of the first annular groove 8*d*, is attached to the inside of the first annular groove 8*d* as shown in FIG. 9. The spring clip 90 is formed substantially in the shape of a C ring, and has an exterior in which four bent parts 90*a*, 90*b*, 90*c*, and 90*d* are formed to be greater in diameter than the boss 8*a*. The spring clip 90 is structured so that the bent parts 90*a*, 90*b*, 90*c*, and 90*d* undergo elastic deformation in the radial direction and in the circumferential direction against an external force in the radial direction that acts on the four bent parts 90*a*, 90*b*, 90*c*, and 90*d*.

On the other hand, a second annular groove 69 facing the first annular groove 8*d* is formed in an inner sidewall 122*c* of the electromagnetic clutch 42 as shown in FIG. 1. The second annular groove 69 is greater in groove width than the first annular groove 8*d*, and has taper parts 69*b* and 69*c* whose diameters gradually become greater from a groove bottom 69*a* formed between the taper parts 69*b* and 69*c* toward a wall surface of the inner sidewall 122*c* as shown in FIG. 10.

To attach the electromagnetic clutch 42 to the boss 8*a* of the cover 8, the cover 8 is placed on a worktable or the like while directing the boss 8*a* toward the upper surface, and the spring clip 90 is attached to the inside of the first annular groove 8*d* formed in the outer circumferential surface 8*c* of the boss 8*a* of the cover 8. As a result, the spring clip 90 is attached to the first annular groove 8*d* in a state in which the four bent parts 90*a*, 90*b*, 90*c*, and 90*d* protrude from the first annular groove 8*d* as shown in FIG. 9.

Thereafter, the inner sidewall 122*c* is sequentially inserted while pressing the inner peripheral side of the inner sidewall 122*c* of the electromagnetic clutch 42 against the boss 8*a* of the cover 8 to which the spring clip 90 has been attached. As a result, the bent parts 90*a*, 90*b*, 90*c*, and 90*d* undergo elastic deformation in the radial direction and in the circumferential direction in accordance with a movement of the inner sidewall 122*c* of the electromagnetic clutch 42, and are housed in the first annular groove 8*d*. Thereafter, when the inner sidewall 122*c* of the electromagnetic clutch 42 is further moved toward the boss 8*a*, and the second annular groove 69 formed in the inner sidewall 122*c* of the electromagnetic clutch 42 occupies a position that faces the first annular groove 8*d* of the boss 8*a*, the bent parts 90*a*, 90*b*, 90*c*, and 90*d* housed in the first annular groove 8*d* again protrude from the first annular groove 8*d*, and are inserted into the second annular groove 69. As a result, the spring clip 90 is placed ranging from the first annular groove 8*d* of the boss 8*a* to the second annular groove 69 of the electromagnetic clutch 42 (see FIG. 10). In a process in which the electromagnetic clutch 42 is moved toward the cover 8, a positional adjustment is made between the pin 68 protruding from the electromagnetic clutch 42 and the guide groove 8*b* of the cover 8, the pin 68 is then inserted into the guide groove 8*b*, and the electromagnetic clutch 42 is attached to the boss 8*a* of the cover 8. At this time, the electromagnetic clutch 42 is fixed to the cover 8 by the engagement between the pin 68 and the guide groove 8*b* in a state in which a movement in the circumferential direction is restricted, i.e., in a rotationally stopped state.

After being attached to the boss 8*a* of the cover 8, the electromagnetic clutch 42 is prevented (stopped) from moving in the vertical axis direction (i.e., in the direction perpendicular to the radial direction of the boss 8*a*) owing to contact with the bent parts 90*a*, 90*b*, 90*c*, and 90*d* of the spring clip 90 placed ranging from the first annular groove 8*d* of the boss 8*a* to the second annular groove 69 of the electromagnetic clutch 42 even if the electromagnetic clutch 42 is directed toward the lower surface. Therefore, the electromagnetic clutch 42 can be prevented from dropping (falling) off from the cover 8, and workability can be improved when the cover 8 to which the electromagnetic clutch 42 has been attached is carried, is packed, and is installed.

On the other hand, when the electromagnetic clutch 42 attached to the boss 8*a* of the cover 8 is attached to an end in the axial direction of the camshaft 2 while being directed toward the rotational drum 44, the electromagnetic clutch 42 is prevented (stopped) from moving in the axial direction of the camshaft 2 owing to contact with the spring clip 90 placed ranging from the first annular groove 8*d* of the boss 8*a* to the second annular groove 69 of the electromagnetic clutch 42. However, after the electromagnetic clutch 42 is installed in the engine, the motion of the electromagnetic clutch 42 is never disturbed by interference with the spring clip 90 and the second annular groove 69 because the spring clip 90 is positioned substantially at the center of the second annular groove 69 greater in groove width than the first annular groove 8*d* while facing this center.

In the basic structure, to install the phase varying apparatus, the cam bolt 19 is first passed through the inner cylinder part 20, and then the forward end of the cam bolt 19 is tightened to the camshaft 2. At this time, the tightening force of the cam bolt 19 acts on the bearing 26 through the stopper 27. As a result, the bearing 26 is attached to the stepped part 20*c*, and is fixed to the outer circumferential surface of the stepped part 20*c* in the state of being prevented from moving toward the camshaft 2 owing to contact with the wall surface of the stepped part 20*b* and in the state of being prevented from moving toward the head 19*a* of the cam bolt 19 owing to contact with the stopper 27 supported by the head 19*a* of the cam bolt 19 and contact with the C ring (washer) 28 supported by the rotational drum 44.

On the other hand, the electromagnetic clutch 42 is attached to the cover 8, and, finally, the cover 8 to which the electromagnetic clutch 42 has been attached is disposed in such a way as to allow the boss 8*a* to surround the cam bolt 19, and the electromagnetic clutch 42 is disposed to face the rotational drum 44, thus fixing the cover 8 to the engine (not shown).

With the thus formed basic structure, after the electromagnetic clutch 42 is attached to the boss 8*a* of the cover 8, the electromagnetic clutch 42 is prevented (stopped) from moving in the vertical axis direction (i.e., in the direction perpendicular to the radial direction of the boss 8*a*) owing to contact with the spring clip 90 placed ranging from the first annular groove 8*d* of the boss 8*a* to the second annular groove 69 of the electromagnetic clutch 42 even if the electromagnetic clutch 42 is directed toward the lower surface. Therefore, the electromagnetic clutch 42 can be prevented from dropping (falling) off from the cover 8, and workability can be improved when the cover 8 to which the electromagnetic clutch 42 has been attached is carried, is packed, and is installed.

Next, referring to FIG. 11, a first embodiment of the present invention will be described as an embodiment obtained by improving the basic structure. In this embodiment, the bottom of the cover 8 is formed like a flat plate by removing the boss 8*a* from the cover 8, an annular stopper 51 is used instead of the stopper 27, a bearing (second bearing) 52 is attached to a stepped part 51*a* formed on the side of the outer periphery of the stopper 51, the inner sidewall 122*c* of the electromagnetic clutch 42 is supported by the bearing 52, the outer ring side of the bearing 52 is supported by the clip 128 attached to the inside of an annular groove 127 formed in the inner sidewall 122*c*, and a movement of the bearing 52 in the axial direction is prevented by the clip 128. Structural forms other than these structural forms are the same as those of the basic structure.

In this embodiment, to install the phase varying apparatus, the outer ring side of the bearing 52 is first attached to the electromagnetic clutch 42, and then the clip 128 is inserted into the groove 127 of the electromagnetic clutch 42, and the bearing 52 is fixed to the electromagnetic clutch 42. Thereafter, the cam bolt 19 is passed through the inner cylinder part 20, and the forward end of the cam bolt 19 is tightened to the camshaft 2. Thereafter, the inner ring side of the bearing 52 fixed to the electromagnetic clutch 42 is attached to the stepped part 51*a* of the stopper 51, and the electromagnetic clutch 42 is disposed to face the rotational drum 44 in such a way as to surround the bearing 52. With this form, the electromagnetic clutch 42 is held on the side of the rotating part that is the main body while a magnetic force is acting among the inner sidewall 122*c* and the outer sidewall 122*b* constituting a claw part of the electromagnetic clutch 42 and the magnet 45 so as to attract each other.

Thereafter, the cover 8 is attached to the electromagnetic clutch 42 in such a way as to surround the electromagnetic clutch 42. At this time, the electromagnetic clutch 42 is moved in the circumferential direction, and the pin 68 is inserted into the guide groove 8*b*. As a result, the electromagnetic clutch 42 is fixed to the cover 8 in the state of being prevented from moving in the circumferential direction by the engagement between the pin 68 and the guide groove 8*b*, i.e., in the rotation-stopped state.

At this time, the rotational drum 44 is rotatably supported by the inner cylinder part 20 connected to the camshaft 2 with the first bearing 26 therebetween, and the electromagnetic clutch 42 is connected to the inner cylinder part 20 through the second bearing 52 and the annular stopper 51, and is supported by the cover 8 so as not to be rotated. Therefore, even if the camshaft 2 vibrates in accordance with the operation of the engine so that the vibrations of the camshaft 2 are transmitted to the inner cylinder part 20 and so that the rotational drum 44 and the electromagnetic clutch 42 start moving in the radial direction of the camshaft 2, the movements of the rotational drum 44 and the electromagnetic clutch 42 in the radial direction of the camshaft 2 are prevented by the rotations of the first bearing 26 and the second bearing 52, and, as shown in FIG. 12, an air-gap AG between the electromagnetic clutch 42 and the magnet 45 fixed to the rotational drum 44, which is a distance in the radial direction of the camshaft 2 and the inner cylinder part 20, can be kept within a predetermined range. Since this air-gap AG influences the strength of a magnetic force acting between the magnet 45 and the electromagnetic clutch 42, an electromagnetic force generated from the electromagnetic clutch 42 can be controlled stably at any time by keeping the air-gap AG within the predetermined range.

According to this embodiment, the rotational drum 44 is supported by the bearing (first bearing) 26 prevented from moving in the axial direction, and the electromagnetic clutch 42 is supported by the bearing (second bearing) 52 prevented form moving in the axial direction. Therefore, even if the camshaft 2 vibrates in accordance with the operation of the engine, and even if vibrations of the camshaft 2 are transmitted to the inner cylinder part 20 so that the rotational drum 44 and the electromagnetic clutch 42 move in the radial direction of the camshaft 2, the movements of the rotational drum 44 and electromagnetic clutch 42 in the radial direction of the camshaft 2 are prevented by the rotations of the first bearing 26 and the second bearing 52. Therefore, an air-gap AG between the electromagnetic clutch 42 and the magnet 45 fixed to the rotational drum 44 can be kept at a predetermined distance, and can be easily managed. Additionally, an electromagnetic force generated from the electromagnetic clutch can be controlled stably at any time, and the positioning accuracy in the circumferential direction of the electromagnetic clutch 42 and the magnet 45 can be determined by the dimensional accuracy of the bearings 26 and 51.

Additionally, according to this embodiment, to install the phase varying apparatus in the engine, the electromagnetic clutch 42 is first attached thereto, and then the cover 8 is attached thereto. Therefore, when the electromagnetic clutch 42 is attached thereto, the electromagnetic clutch 42 can be set while observing the state of the main body including the inner cylinder part 20, the intermediate member 30, the spline case 16, and the outer cylinder part 10 or while observing the state of the rotational drum 44. Additionally, since the magnetic force enables an attracting force to act on the rotational drum 44 as a holding force, a mechanism used to prevent the electromagnetic clutch 42 from dropping off becomes unnecessary.

Next, a second embodiment of the present invention will be described with reference to FIG. 13 and FIG. 14. In this embodiment, a sliding bearing (second bearing) 53 inserted between the electromagnetic clutch 42 and the rotational drum 44 supports the inner sidewall 122*c* of the electromagnetic clutch 42, and prevents the rotational drum 44 and the electromagnetic clutch 42 from moving in the axial direction. Structural forms other than these structural forms are the same as those of the basic structure.

The sliding bearing 53 formed in an annular shape includes a cylindrical part 53*a* and a projection 53*b*, and is attached to the outer periphery of the cylindrical part 44*d* of the rotational drum 44. The cylindrical part 53*a* is inserted between the inner sidewall 122*c* of the electromagnetic clutch 42 and the cylindrical part 44*d* of the rotational drum 44, and supports the inner sidewall 122*c* of the electromagnetic clutch 42 on the cylindrical part 44*d* of the rotational drum 44. As shown in FIG. 14, the projections 53*b* are formed on the side of the outer periphery of the cylindrical part 53*a* with equal intervals or different intervals. Each projection 53*b* is inserted in a space between the inner magnetized piece 126*a* and the inner magnetized piece 126*a* formed on the inner sidewall 122*c* of the electromagnetic clutch 42, and is inserted between an end of the inner sidewall 122*c* of the electromagnetic clutch 42 and the flange part 44*a* of the rotational drum 44. In other words, the sliding bearing 53 allows the cylindrical part 53*a* to support the inner sidewall 122*c* of the electromagnetic clutch 42 on the cylindrical part 44*d* of the rotational drum 44, and allows the projections 53*b* to prevent the electromagnetic clutch 42 from moving in the axial direction and in the circumferential direction.

In this embodiment, to install the phase varying apparatus, the cam bolt 19 is passed through the inner cylinder part 20, and the forward end of the cam bolt 19 is tightened to the camshaft 2. Thereafter, the outer ring side of the sliding bearing 53 is attached to the electromagnetic clutch 42, and the sliding bearing 53 is fixed to the electromagnetic clutch 42. Thereafter, the inner sidewall 122*c* of the electromagnetic clutch 42 is attached to the boss 8*a* of the cover 8, and the electromagnetic clutch 42 is fixed to the cover 8. Thereafter, the sliding bearing 53 is set in the electromagnetic clutch 42, and the cover 8 to which the electromagnetic clutch 42 has been fixed is installed in the engine. During this operation, a centering function of the sliding bearing 53 (i.e., a centering function resulting from the insertion of the inner part of the sliding bearing 53 into the outer wall of the rotational drum 44) is fulfilled even if a disturbance acts owing to the attracting force of the magnet 45, and hence the assembly operation can be easily performed.

According to this embodiment, the rotational drum 44 is supported by the bearing (first bearing) 26 prevented from moving in the axial direction, and the electromagnetic clutch 42 is supported by the sliding bearing (second bearing) 53 prevented from moving in the axial direction. Therefore, when the camshaft 2 vibrates in accordance with the operation of the engine, and when vibrations of the camshaft 2 are transmitted to the inner cylinder part 20 so that the rotational drum 44 and the electromagnetic clutch 42 move in the radial direction of the camshaft 2, vibrations in the radial direction of the rotational drum 44 are transmitted to the electromagnetic clutch 42 through the second bearing 53 as vibrations generated in the same direction. Therefore, an air-gap AG between the electromagnetic clutch 42 and the magnet 45 fixed to the rotational drum 44 can be kept at a predetermined distance, and hence can be easily managed, and an electromagnetic force generated from the electromagnetic clutch can be controlled stably at any time.

In this case, since the sliding bearing 53 is inserted between the electromagnetic clutch 42 and the rotational drum 44, the electromagnetic clutch 42 and the rotational drum 44 can be directly positioned by the sliding bearing 53, and the air-gap AG between the electromagnetic clutch 42 and the magnet 45 can be managed with higher accuracy, and can be achieved at lower cost than in the above-mentioned embodiment.

Additionally, when the electromagnetic clutch 42 is installed, a centering function of the sliding bearing 53 (i.e., a centering function resulting from the insertion of the inner part of the sliding bearing 53 into the outer wall of the rotational drum 44) is fulfilled even if a disturbance acts owing to the attracting force of the magnet 45, and hence the assembly operation can be easily performed.

Additionally, according to this embodiment, after the electromagnetic clutch 42 is attached to the boss 8*a* of the cover 8, the electromagnetic clutch 42 can be prevented from dropping (falling) off from the cover 8 even if the electromagnetic clutch 42 is directed toward the lower surface, and workability can be improved when the cover 8 to which the electromagnetic clutch 42 has been attached is carried, is packed, and is installed.

Next, a third embodiment of the present invention will be described with reference to FIG. 15. In this embodiment, the bottom of the cover 8 is formed substantially in the shape of a bowl by removing the boss 8*a* from the cover 8, the rotational drum 44 is disposed on the side of the cover 8, the electromagnetic clutch 42 is disposed between the rotational drum 44 and the outer cylinder part 10 in the state of facing an opposite direction, a cylindrical boss 16*a* is formed on the spline case 16, a stepped part 16*b* and a screw part 16*c* are formed on the outer periphery of the boss 16*a*, a stepped part 130 and a screw part 131 are formed on the inner sidewall 122*c* of the electromagnetic clutch 42, a bearing (second bearing) 54 is attached to the stepped part 16*b* and to the stepped part 130, the inner sidewall 122*c* of the electromagnetic clutch 42 is supported by the bearing 54, the outer ring side of the bearing 54 is supported by a bearing nut 132 screwed to the screw part 131 of the inner sidewall 122*c*, the inner ring side of the bearing 54 is supported by a bearing nut 133 screwed to the screw part 16*c* of the spline case 16, and the bearing nuts 132 and 133 prevent the bearing 54 from moving in the axial direction. Structural forms other than these structural forms are the same as those of the basic structure.

In this embodiment, to install the phase varying apparatus, the electromagnetic clutch 42 is first attached to the spline case 16 with the bearing 54 therebetween. Thereafter, the rotational drum 44, the bearing 26, and the stopper 27 are sequentially attached, thus completing the assembly as a main body having the electromagnetic clutch.

Thereafter, the cam bolt 19 is passed through the inner cylinder part 20, and the forward end of the cam bolt 19 is tightened to the camshaft 2. Thereafter, the cover 8 is disposed in such a way as to surround the rotational drum 44 and the electromagnetic clutch 42, and is installed in the engine. At this time, a pin 68 is inserted into the guide groove 8*b* while moving the electromagnetic clutch 42 in the circumferential direction. As a result, the electromagnetic clutch 42 is fixed to the cover 8 by the engagement between the pin 68 and the guide groove 8*b* in the state of being prevented from moving in the circumferential direction, i.e., in the rotation-stopped state.

According to this embodiment, the rotational drum 44 is supported by the bearing (first bearing) 26 prevented from moving in the axial direction, and the electromagnetic clutch 42 is supported by the bearing (second bearing) 54 prevented from moving in the axial direction. Therefore, when the camshaft 2 vibrates in accordance with the operation of the engine, and when vibrations of the camshaft 2 are transmitted to the inner cylinder part 20 and to the outer cylinder part 10 so that the rotational drum 44 and the electromagnetic clutch 42 move in the radial direction of the camshaft 2, vibrations in the radial direction of the camshaft 2 are transmitted to the rotational drum 44 through the first bearing 26, and are transmitted to the electromagnetic clutch 42 through the second bearing 54 as vibrations in the same direction. Therefore, an air-gap AG between the electromagnetic clutch 42 and the magnet 45 can be kept within a predetermined range, and can be easily managed. Additionally, an electromagnetic force generated from the electromagnetic clutch can be controlled stably at any time, and the positioning accuracy in the circumferential direction of the electromagnetic clutch 42 and the magnet 45 can be determined by the dimensional accuracy of the bearings 26 and 54.

Additionally, according to this embodiment, to install the phase varying apparatus in the engine, the electromagnetic clutch 42 is first attached thereto, and then the cover 8 is attached thereto. Therefore, a mechanism to prevent the electromagnetic clutch 42 from dropping off becomes unnecessary.

Still additionally, according to this embodiment, a one-unit structure can be achieved, and handling can be more easily performed than in the above-mentioned embodiments.

Next, a fourth embodiment of the present invention will be described with reference to FIG. 16. In this embodiment, a concave part 8*e* is formed in the bottom of the cover 8, the side of the head 19*a* of the cam bolt 19 is housed in the concave part 8*e*, a stepped part 8*f* is formed between the boss 8*a* and the concave part 8*e*, a bearing (second bearing) 55 is attached to the stepped part 8*f*, the bearing 55 instead of the stopper 27 is attached to the stepped part 20*c* of the inner cylinder part 20 in parallel with the bearing 26, and the bearing 55 and the cam bolt 19 prevent the bearing 26 from moving in the axial direction. Structural forms other than these structural forms are the same as those of the basic structure.

In this embodiment, to install the phase varying apparatus, the bearing 55 is first pressed and fitted adjacent to the bearing 26. Thereafter, the cam bolt 19 is passed through the inner cylinder part 20, and the forward end of the cam bolt 19 is tightened to the camshaft 2. Thereafter, the inner sidewall 122*c* of the electromagnetic clutch 42 is attached to the boss 8*a* of the cover 8, and the electromagnetic clutch 42 is fixed to the cover 8. Thereafter, the cover 8 to which the electromagnetic clutch 42 has been fixed is installed in the engine. In this operation, the cover 8 is installed in the engine while centering the cover 8 and the bearing 55.

According to this embodiment, the second bearing 55, which has been attached to the stepped part 8*f* and which has been fixed to the inner cylinder part 20 by means of the cam bolt 19, is connected to the cover 8, and the rotational drum 44 is supported by the bearing (first bearing) 26 prevented from moving in the axial direction. Therefore, even if the camshaft 2 vibrates in accordance with the operation of the engine, and even if vibrations of the camshaft 2 are transmitted to the inner cylinder part 20 so that the rotational drum 44 and the electromagnetic clutch 42 move in the radial direction of the camshaft 2, the vibrations in the radial direction of the camshaft 2 are absorbed by the second bearing 55. Therefore, an air-gap AG between the electromagnetic clutch 42 and the magnet 45 can be kept within a predetermined range, and can be easily managed. Additionally, an electromagnetic force generated from the electromagnetic clutch 42 can be controlled stably at any time, and the positioning accuracy in the circumferential direction of the electromagnetic clutch 42 and the magnet 45 can be determined by the dimensional accuracy of the bearings 26 and 55.

Additionally, according to this embodiment, since the side of an end in the axial direction of the camshaft 2 is rotatably supported by the bearing 55 through the cam bolt 19, the camshaft 2 can be prevented from being joltingly rotated during the operation of the engine.

Additionally, according to this embodiment, after the electromagnetic clutch 42 is attached to the boss 8*a* of the cover 8, the electromagnetic clutch 42 can be prevented from dropping (falling) off from the cover 8 even if the electromagnetic clutch 42 is directed toward the lower surface, and workability can be improved when the cover 8 to which the electromagnetic clutch 42 has been attached is carried, is packed, and is installed.

Next, a fifth embodiment of the present invention will be described with reference to FIG. 17. In this embodiment, one or two concave parts 134 are formed in the inner sidewall 122*c* of the electromagnetic clutch 42, and one or two concave parts 8*g* are formed in the boss 8*a* of the cover 8. When the electromagnetic clutch 42 is attached to the boss 8*a* of the cover 8, the electromagnetic clutch 42 is fixed to the cover 8 by tightening the concave part 8*g* toward the inner sidewall 122*c* by use of a tool, such as a punch, and by inserting the concave part 8*g* into the concave part 134 of the inner sidewall 122*c*. Structural forms other than these structural forms are the same as in any one of the first to fourth embodiments.

According to this embodiment, the electromagnetic clutch 42 can be fixed to the cover 8 by an easy operation using a tool such as a punch.

Next, a sixth embodiment of the present invention will be described with reference to FIG. 18. In this embodiment, one or two tongue-like pieces 135 are formed on the inner sidewall 122*c* of the electromagnetic clutch 42, one or two concave parts 8*h* are formed in the boss 8*a* of the cover 8, and the electromagnetic clutch 42 is fixed to the cover 8 by tightening the tongue-like piece 135 toward the boss 8*a* by use of a tool, such as a punch, and by inserting the tongue-like piece 135 into the concave part 8*h* of the boss 8*a* when the electromagnetic clutch 42 is attached to the boss 8*a* of the cover 8. Structural forms other than these structural forms are the same as in any one of the first to fourth embodiments.

According to this embodiment, the electromagnetic clutch 42 can be fixed to the cover 8 by an easy operation using a tool such as a punch.

Next, a seventh embodiment of the present invention will be described with reference to FIG. 19. This embodiment is a modification of the second embodiment. In this embodiment, to mount the electromagnetic clutch 42 on an engine head 3, annular bosses 3*a* and 3*b* are formed on the engine head 3, a guide groove 3*c* used to prevent a rotation stop is formed in the boss 3*a*, the electromagnetic clutch 42 is attached between the boss 3*a* and the boss 3*b*, the pin 68 is inserted into the guide groove 3*c*, an outer cylinder part 10A is disposed farthest from the engine head 3, a stopper 27A is tightened to the camshaft 2, the stopper 27A, the bearing 26, and a spline case 16A are disposed on the outer periphery of the inner cylinder part 20A in order from the side of the engine head 3, an auxiliary outer cylinder part 11A is disposed between the rotational drum 44 and the outer cylinder part 10A, a spline case 16A is disposed between the auxiliary outer cylinder part 11A and the outer cylinder part 10A, the sliding bearing 53 is inserted between the electromagnetic clutch 42 and the rotational drum 44, the outer ring side of the bearing 26 is connected to the rotational drum 44, and the inner ring side thereof is connected to the outer periphery of the inner cylinder part 20. Structural forms other than these structural forms are the same as in the second embodiment. The outer cylinder part 1A, the auxiliary outer cylinder part 11A, the inner cylinder part 12A, the spline case 16A, and the stopper 27A differ only in shape from the outer cylinder part 10, the auxiliary outer cylinder part 11, the inner cylinder part 12, the spline case 16, and the stopper 27, respectively, and are identical in function therewith. Additionally, a cover whose bottom is flat is used as the cover 8 because there is no need to hold the electromagnetic clutch 42.

In this embodiment, to install the phase varying apparatus, the electromagnetic clutch 42 is first attached between the boss 3*a* and the boss 3*b*, and then the pin 68 is inserted into the guide groove 3*c*, thus mounting the electromagnetic clutch 42 on the engine head 3. In this operation, the sliding bearing 53 is pre-set on the electromagnetic clutch 42. Thereafter, the cam bolt 19 is passed through the inner cylinder part 20, and the forward end of the cam bolt 19 is tightened to the camshaft 2. Thereafter, the cover 8 is attached to the engine head 3 in such a way as to surround the outer cylinder part 1A.

According to this embodiment, the rotational drum 44 is supported by the bearing (first bearing) 26 prevented from moving in the axial direction, the electromagnetic clutch 42 is supported by the bearing (second bearing) 53 prevented from moving in the axial direction, and the electromagnetic clutch 42 is supported by the engine head 3 in a rotationally-stopped manner. Therefore, when the camshaft 2 vibrates in accordance with the operation of the engine, and when vibrations of the camshaft 2 are transmitted to the inner cylinder part 20A so that the rotational drum 44 and the electromagnetic clutch 42 move in the radial direction of the camshaft 2, vibrations in the radial direction of the rotational drum 44 are transmitted to the electromagnetic clutch 42 through the second bearing 53 as vibrations in the same direction. Therefore, an air-gap AG between the electromagnetic clutch 42 and the magnet 45 fixed to the rotational drum 44 can be kept at a predetermined distance, and can be easily managed. Additionally, an electromagnetic force generated from the electromagnetic clutch 42 can be controlled stably at anytime. In this embodiment, since the electromagnetic clutch 42 is mounted directly on the engine head 3, the electromagnetic clutch 42 and the camshaft 2 can be more easily centered than in the above-mentioned embodiments.

Additionally, when the electromagnetic clutch 42 is mounted on the engine head 3, a centering function of the sliding bearing 53 (i.e., a centering function resulting from the insertion of the inner part of the sliding bearing 53 into the outer wall of the rotational drum 44) is fulfilled even if a disturbance acts owing to the attracting force of the magnet 45, and hence the assembly operation can be easily performed.

Although this embodiment has been described as a modification of the second embodiment, a structure in which the electromagnetic clutch 42 is mounted directly on the engine head 3 can be applied to the first embodiment or to the fourth embodiment.

In the above-mentioned embodiments, a structure in which the single coil 120 is attached to the electromagnetic clutch 42 has been described. However, as shown in FIG. 20, the electromagnetic clutch 42 can be structured as a multi coil electromagnetic clutch 42A. More specifically, as shown in FIG. 21, twelve magnets 45 are disposed on the rotational drum 44 so that N poles and S poles are alternately arranged in the circumferential direction, and twelve coils 120A are evenly spaced so as to correspond to the magnets 45, respectively, between the outer sidewall 122*b* and the inner sidewall 122*c* of the electromagnetic clutch 42A. In this case, since an odd-number-th coil and an even-number-th coil have magnetic poles differing from each other (note that "-th" is a suffix used to form ordinal numbers), the magnetic sensor 108 is disposed between, for example, first and second coils of the coils 120A.

Additionally, in the above-mentioned embodiments, as shown in FIG. 22, a structure may be employed in which the pin 68 is formed on the outer sidewall 122*b* of the electromagnetic clutch 42 or 42A in the axial direction, and the guide groove 8*b* used for a rotation stop is formed at a place of the cover 8 corresponding to the pin 68.

A ball bearing, a needle bearing, or a sliding bearing may be used as the bearing in the above-mentioned embodiments.

Additionally, in the above-mentioned embodiments, a magnetic substance, such as iron, or a non-magnetic substance, such as resin or aluminum, may be used as the material of the rotational drum 44. In this case, the whole of the rotational drum 44 may be made of a magnetic substance or a non-magnetic substance. Alternatively, a part of the rotational drum 44 may be made of a magnetic substance or a non-magnetic substance. For example, an area facing an area of the rotational drum 44 which extends on the back side of the magnet 45, which surrounds the magnet 45, and which ranges from the outer sidewall 122*b* to the inner sidewall 122*c* of the electromagnetic clutch 42 (i.e., area surrounded by a so-called claw of the electromagnetic clutch 42) may be made of a magnetic substance or a non-magnetic substance. If at least an area facing an area ranging from the outer sidewall 122*b* to the inner sidewall 122*c* of the electromagnetic clutch 42 is made of a magnetic substance as the material of the rotational drum 44, the magnetic flux density or coercive force of the magnet 45 can be made stronger. On the other hand, if at least an area facing an area ranging from the outer sidewall 122*b* to the inner sidewall 122*c* of the electromagnetic clutch 42 is made of a non-magnetic substance as the material of the rotational drum 44, the flow of a magnetic line of force generated from the magnet 45 can be improved.

DESCRIPTION OF SIGNS

Figure 1:
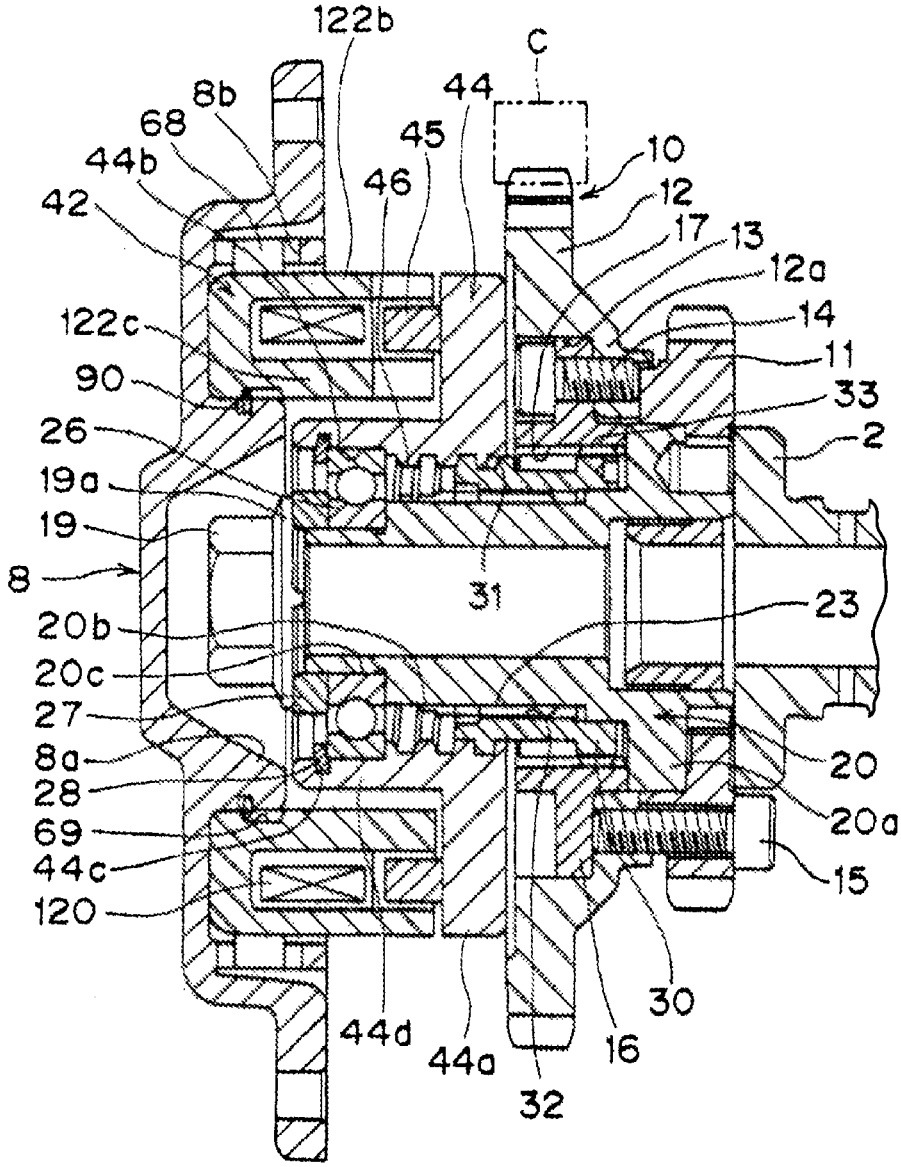
FIG. 1 is a longitudinal sectional view illustrating the basic structure of a phase varying apparatus for use with an engine according to the present invention.
Figure 2:
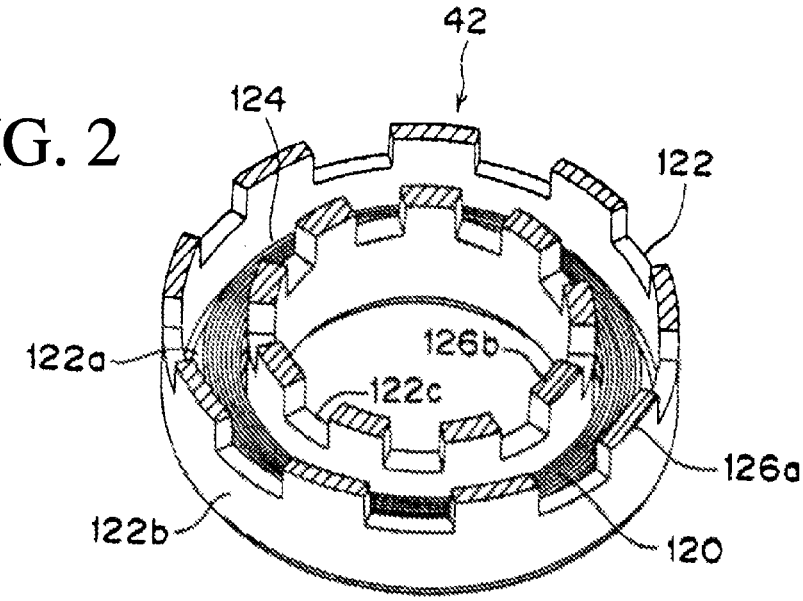
FIG. 2 is a perspective view of an electromagnetic clutch.
Figure 3:
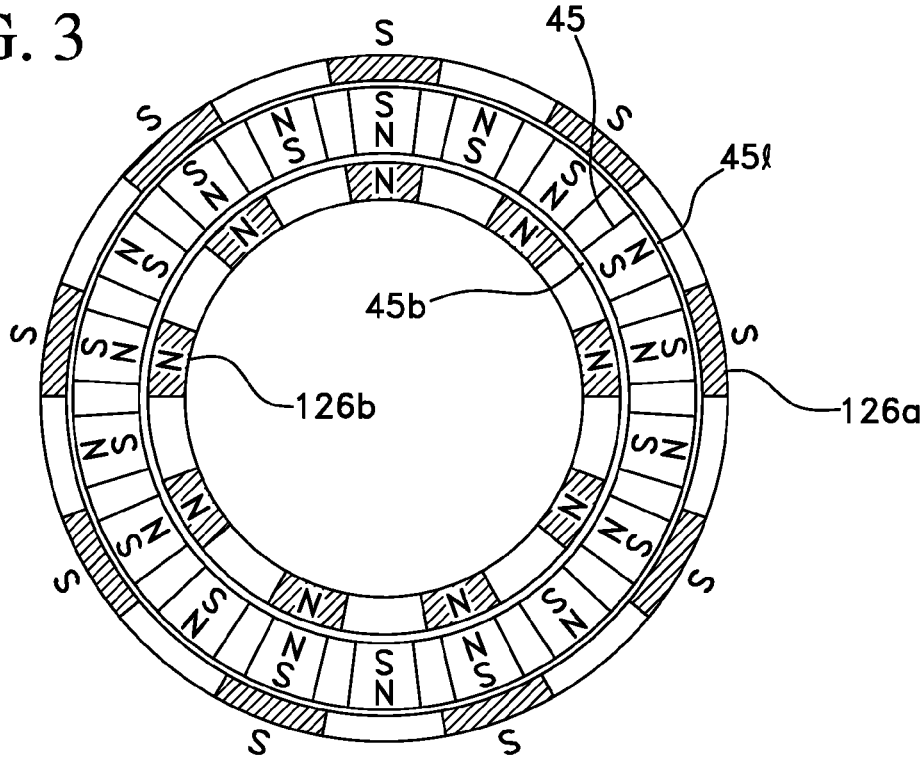
FIG. 3 is a schematic view illustrating the relationship between the electromagnetic clutch and a magnet.
Figure 4:
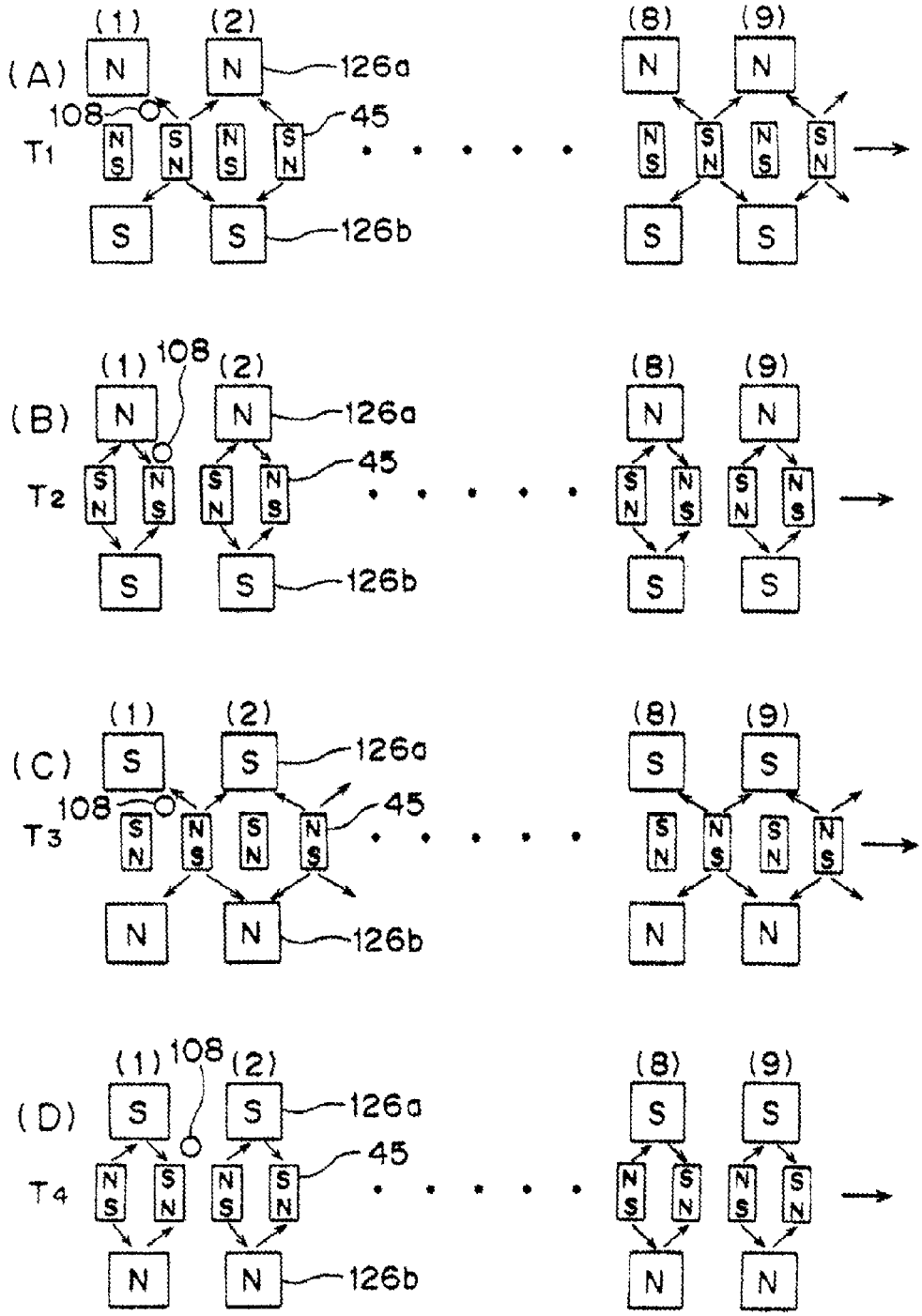
FIG. 4 is a view for explaining a principle by which a rotational drum of the phase varying apparatus is accelerated and decelerated.
Figure 5:
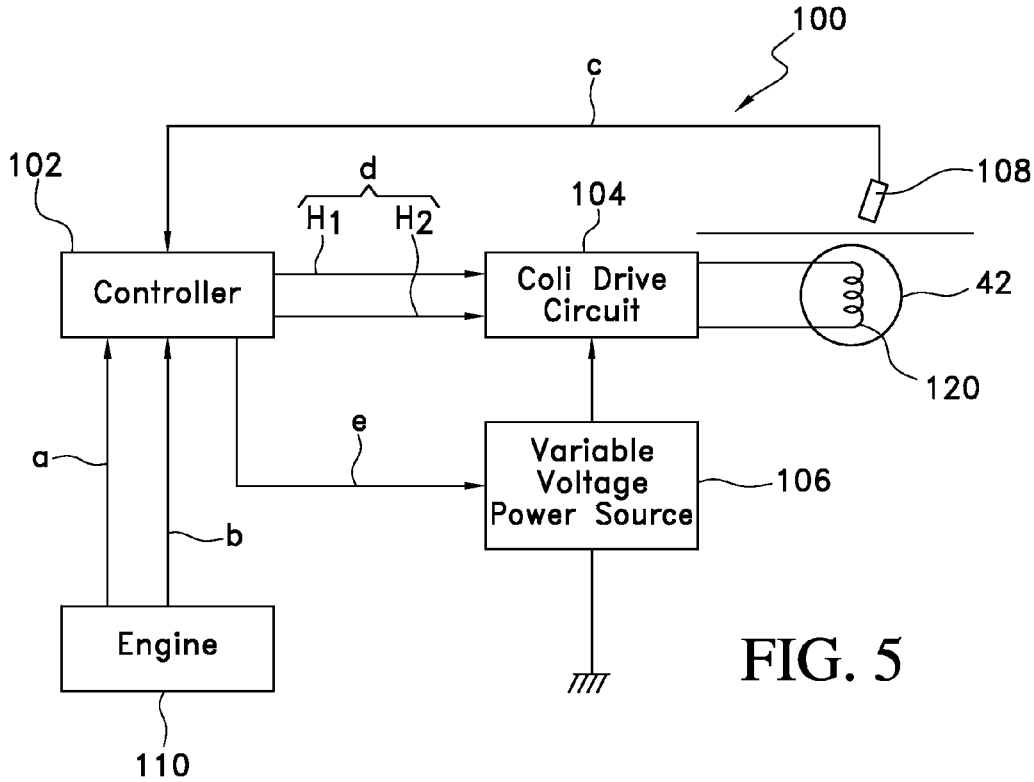
FIG. 5 is a block diagram of a control circuit of the electromagnetic clutch in the phase varying apparatus.
Figure 6:
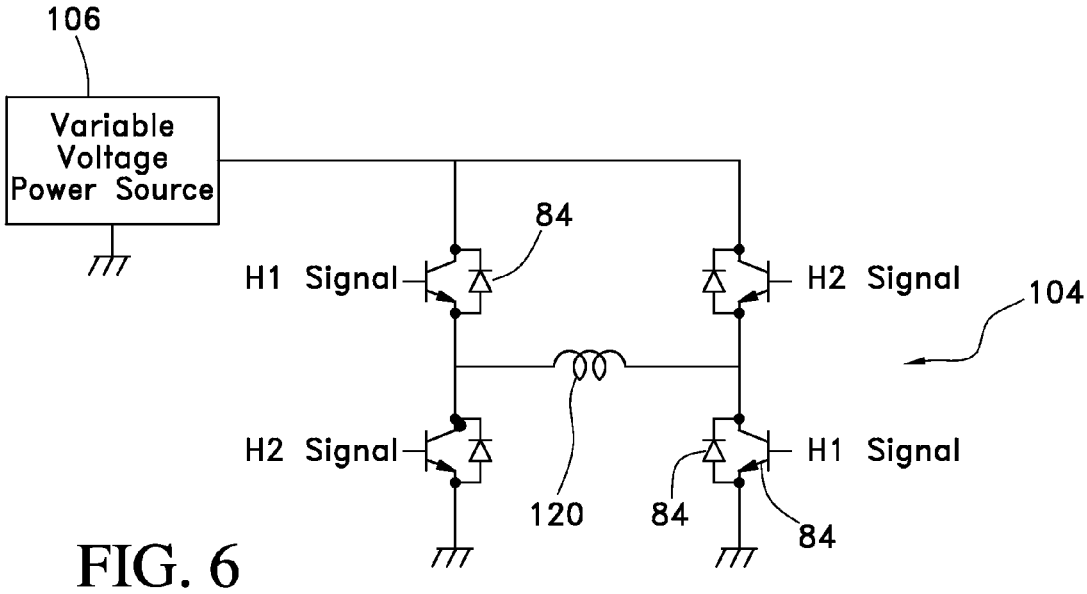
FIG. 6 is a wiring diagram of a coil drive circuit and each coil in the phase varying apparatus.
Figure 7:
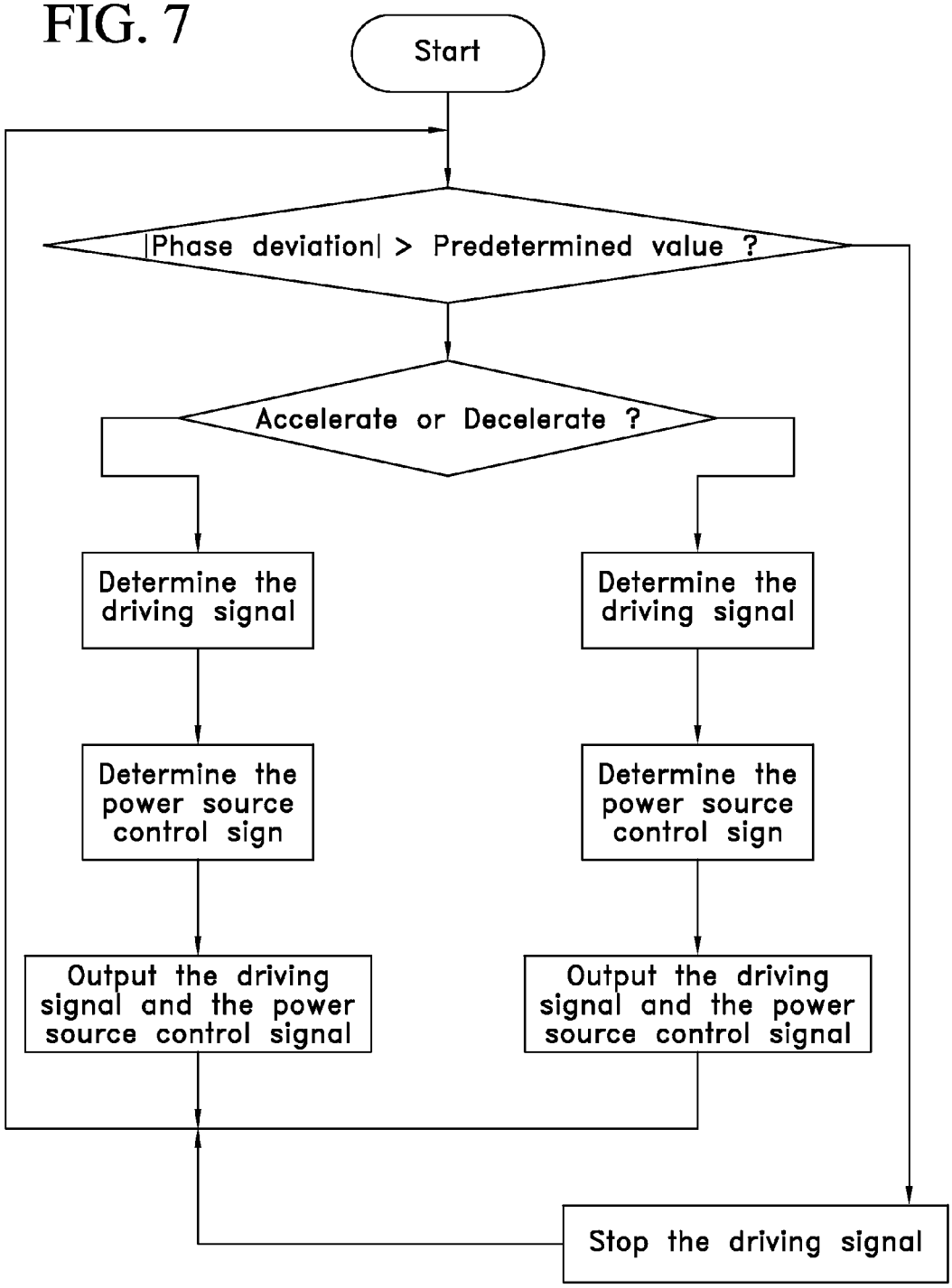
FIG. 7 is a flow chart for explaining the operation of the phase varying apparatus.
Figure 8:
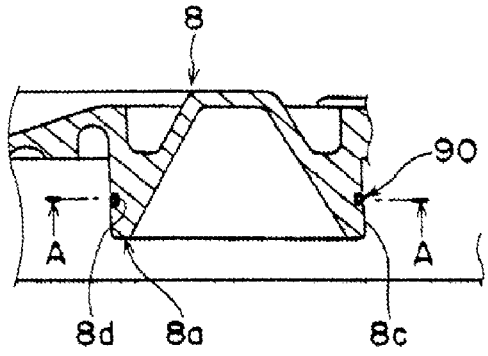
FIG. 8 is a longitudinal sectional view of a main part of a cover to which a spring clip has been attached.
Figure 9:
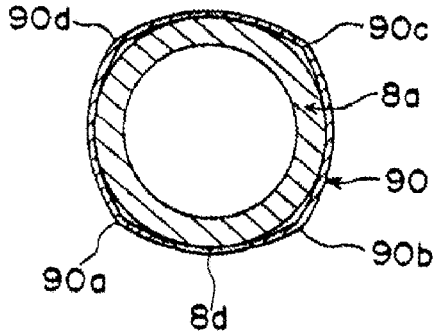
FIG. 9 is a sectional view along the line A-A of FIG. 8.
Figure 10:
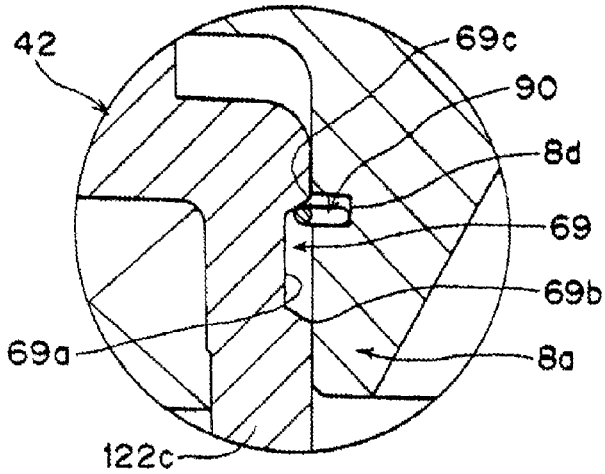
FIG. 10 is an enlarged side sectional view of a main part of a boss of the cover to which the electromagnetic clutch has been attached.
Figure 11:
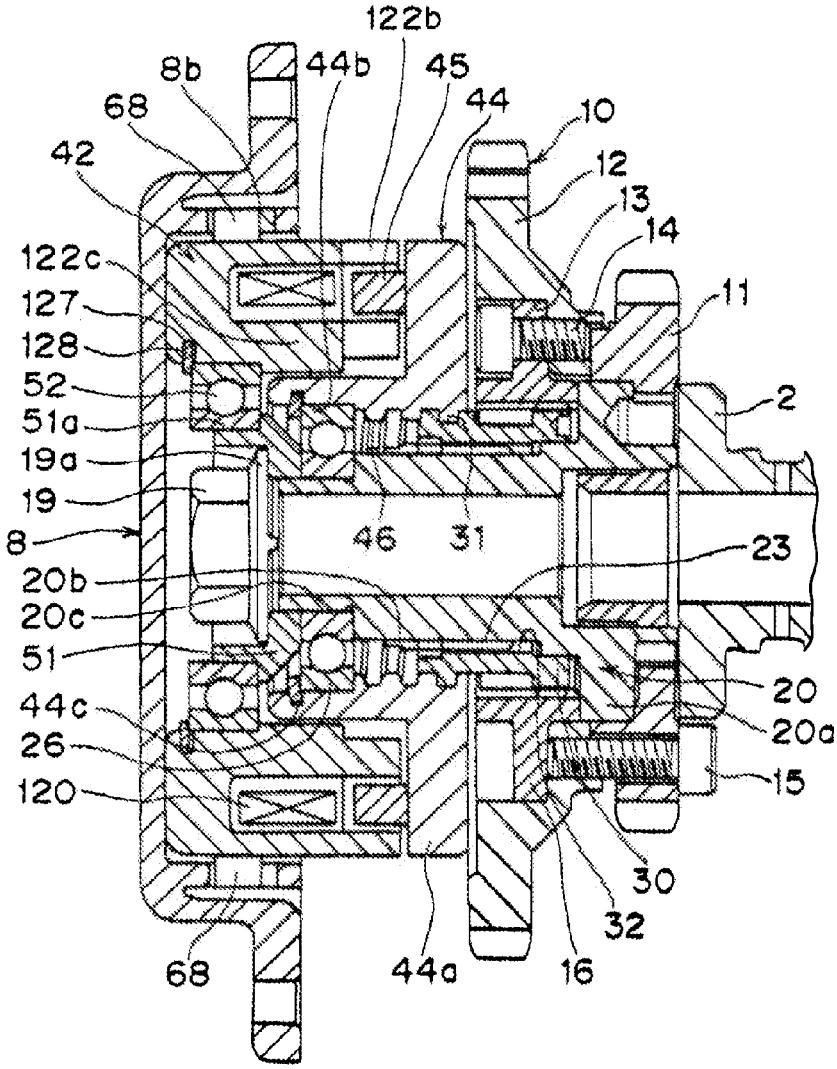
FIG. 11 is a longitudinal sectional view illustrating a first embodiment of the phase varying apparatus for use with an engine according to the present invention.
Figure 12:
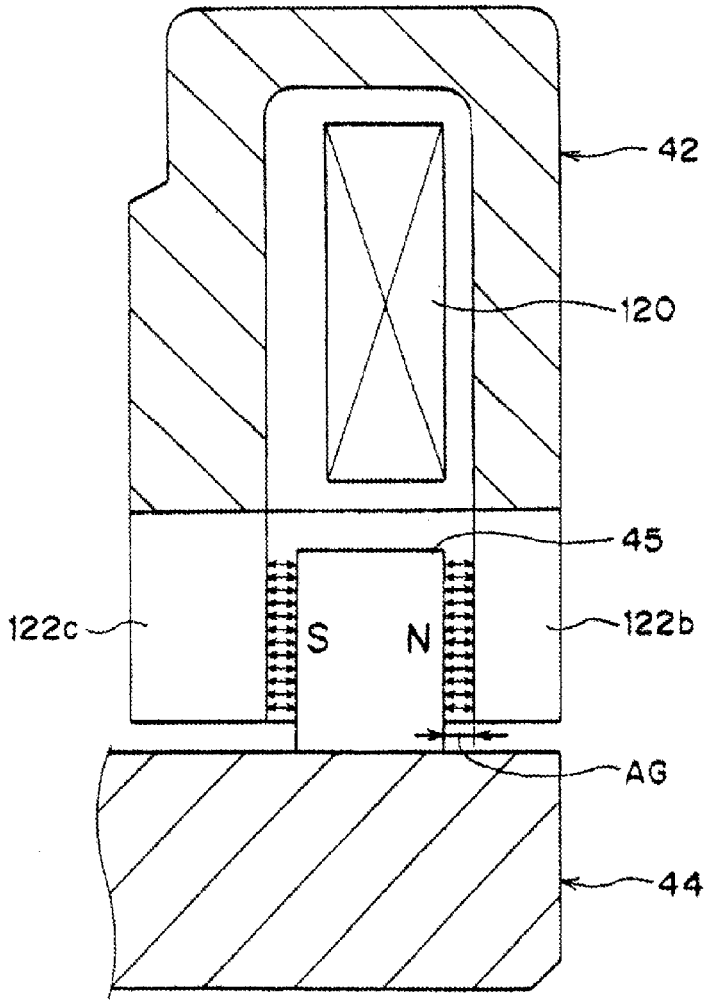
FIG. 12 is a view for explaining an air-gap AG formed between the electromagnetic clutch and the magnet.
Figure 13:
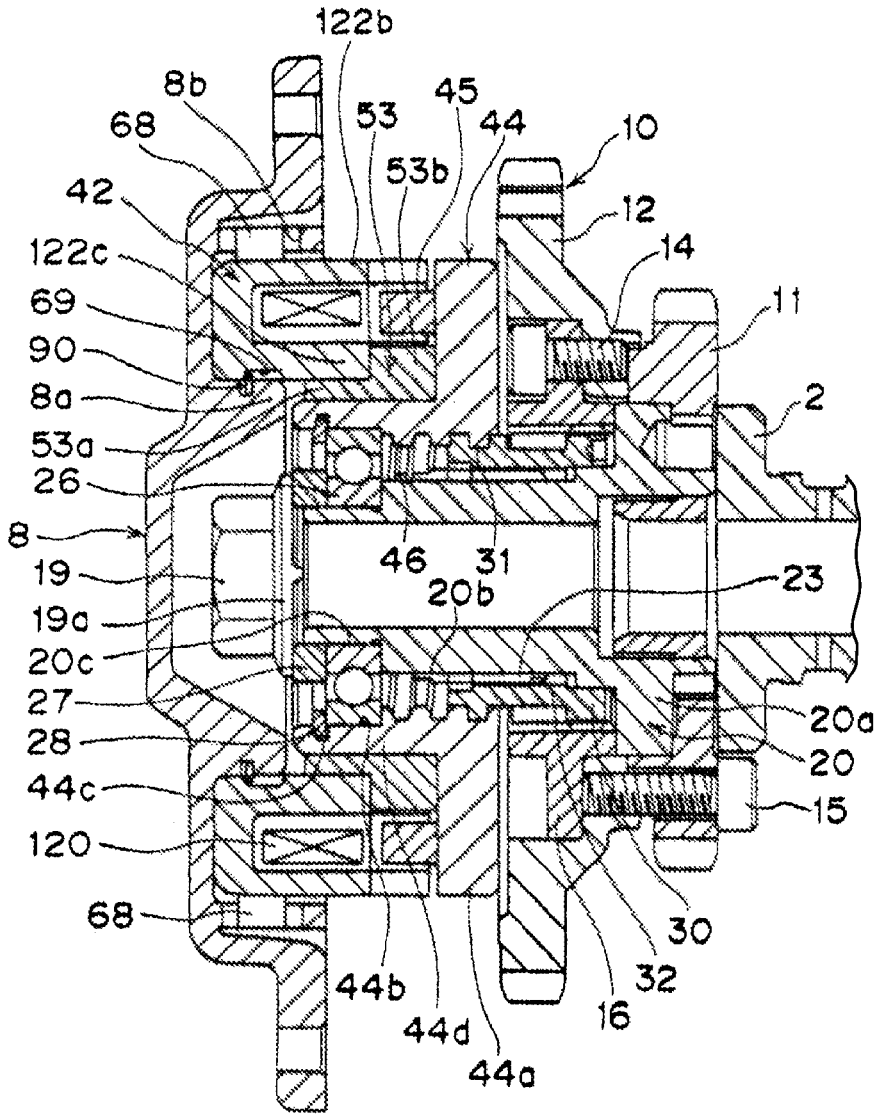
FIG. 13 is a longitudinal sectional view illustrating a second embodiment of the phase varying apparatus for use with an engine according to the present invention.
Figure 14:
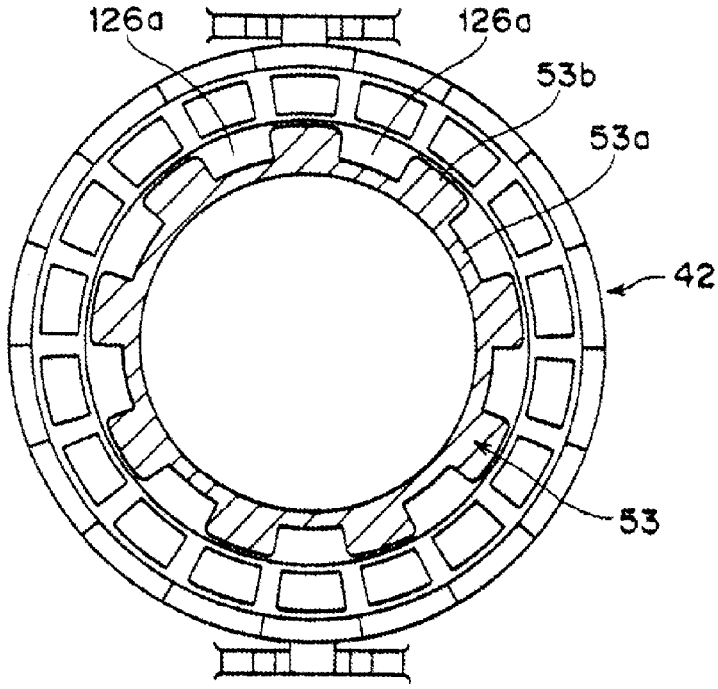
FIG. 14 is a sectional view for explaining the relationship between the electromagnetic clutch and a sliding bearing.
Figure 15:
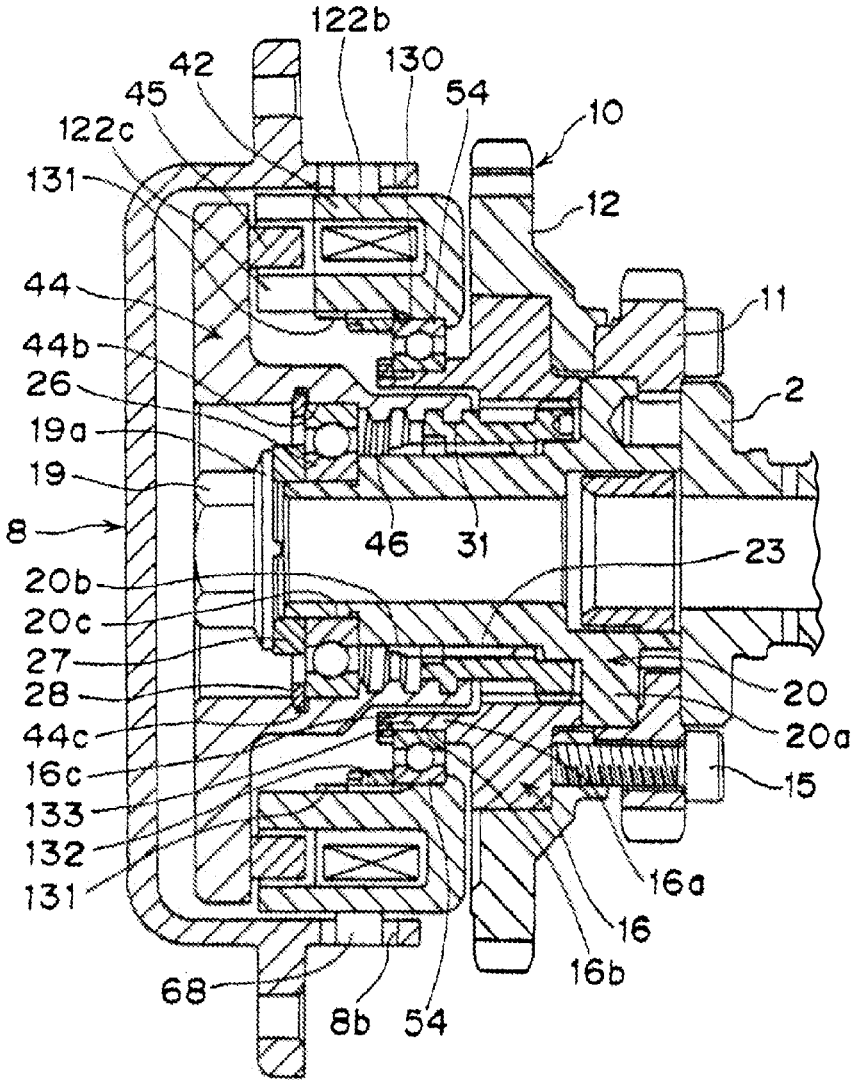
FIG. 15 is a longitudinal sectional view illustrating a third embodiment of the phase varying apparatus for use with an engine according to the present invention.
Figure 16:
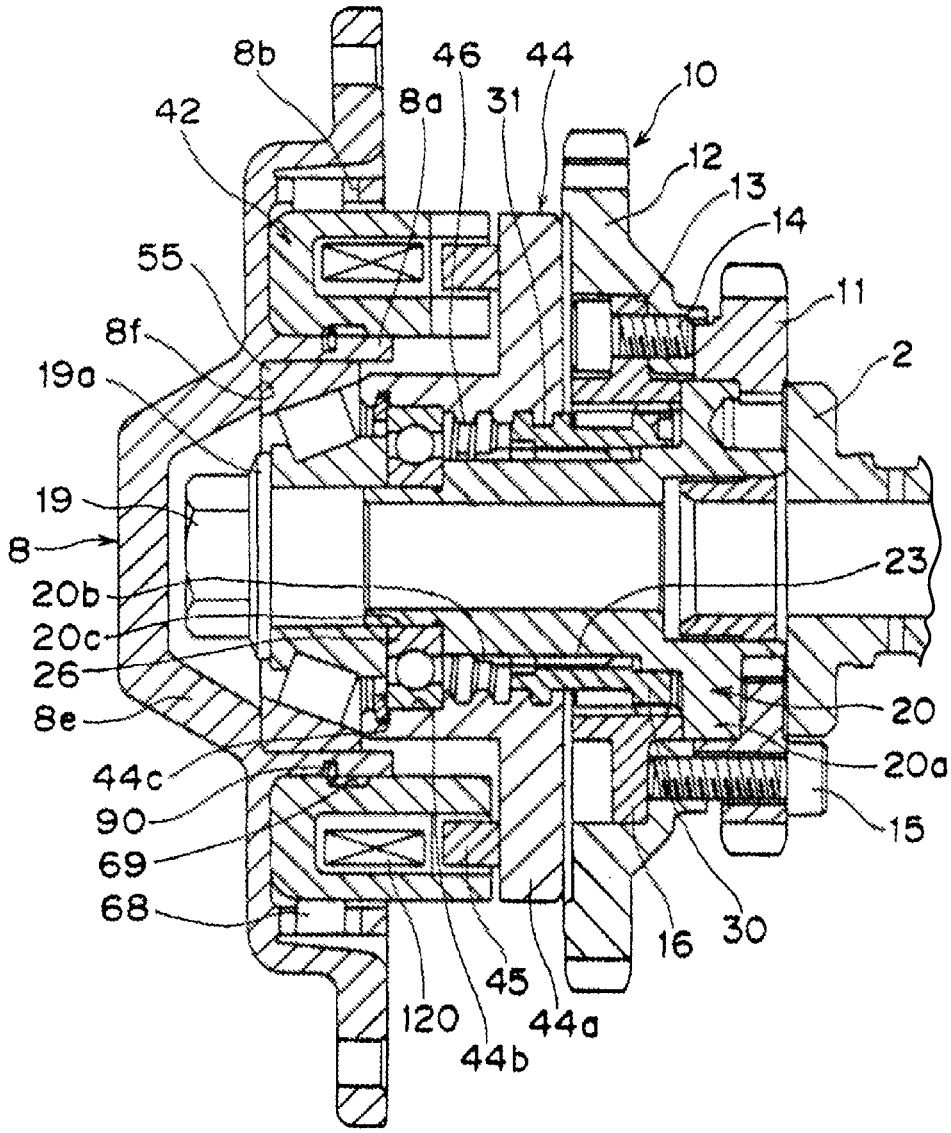
FIG. 16 is a longitudinal sectional view illustrating a fourth embodiment of the phase varying apparatus for use with an engine according to the present invention.
Figure 17:
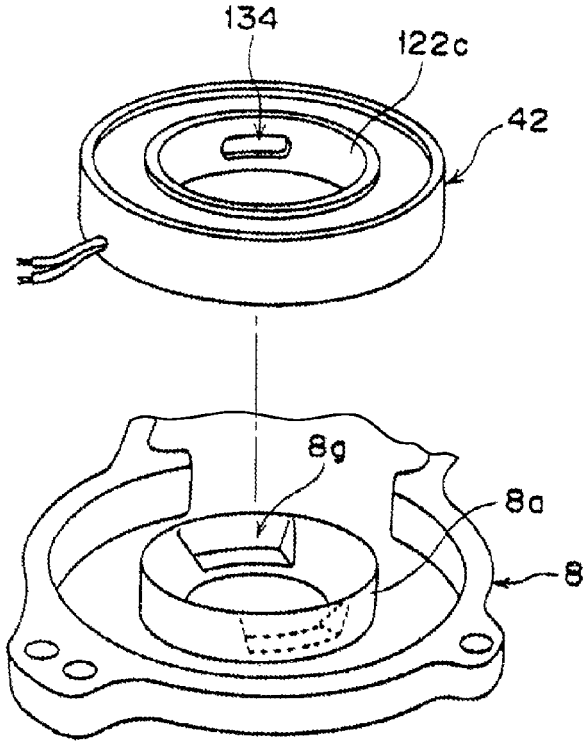
FIG. 17 is an exploded perspective view of the electromagnetic clutch and the cover illustrating a fifth embodiment of the phase varying apparatus for use with an engine according to the present invention.
Figure 18:
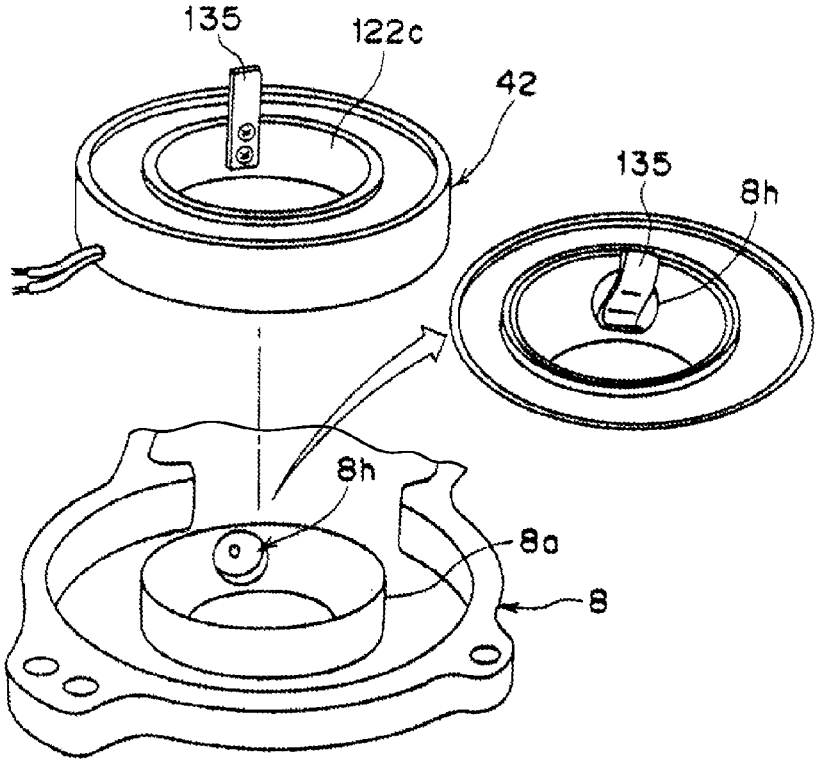
FIG. 18 is an exploded perspective view of the electromagnetic clutch and the cover illustrating a sixth embodiment of the phase varying apparatus for use with an engine according to the present invention.
Figure 19:
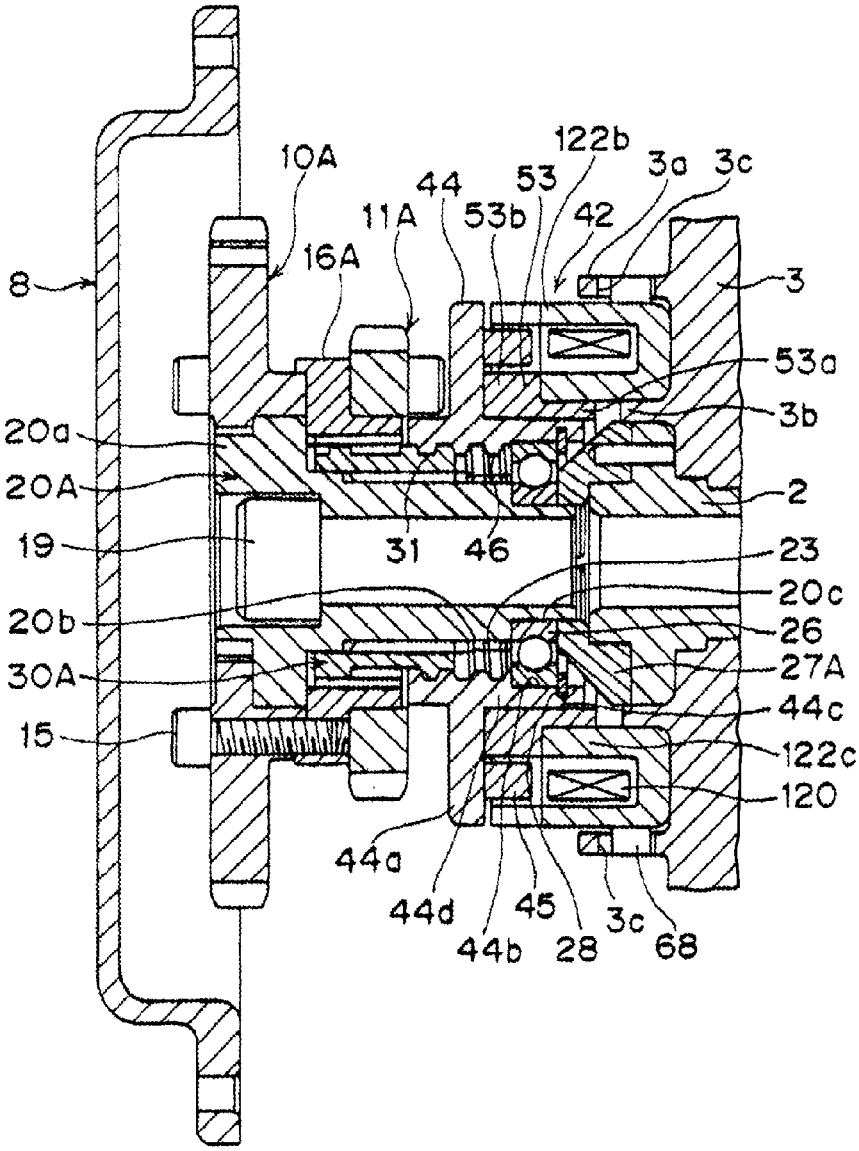
FIG. 19 is a longitudinal sectional view illustrating a seventh embodiment of the phase varying apparatus for use with an engine according to the present invention.
Figure 20:
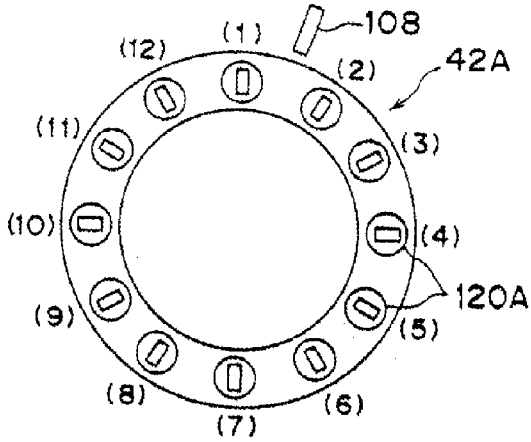
FIG. 20 is a front view illustrating an embodiment of a multicoil electromagnetic clutch.
Figure 21:
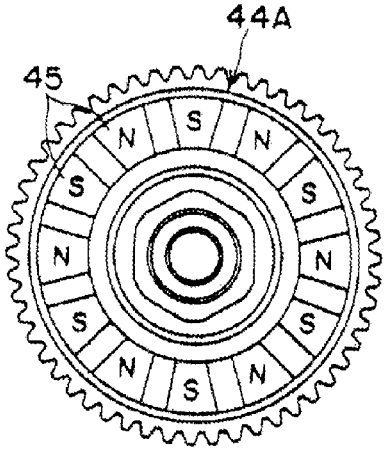
FIG. 21 is a front view illustrating an embodiment of a rotational drum used in the multicoil electromagnetic clutch.
Figure 22:
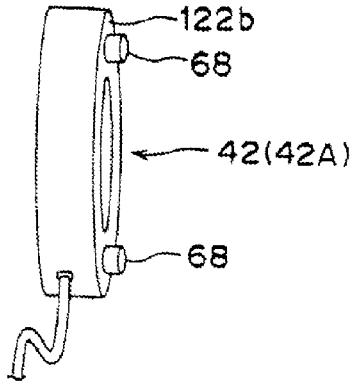
FIG. 22 is a perspective view illustrating an embodiment of the electromagnetic clutch having a pin used for a rotation-stop in the axial direction.

2 Camshaft
10 Outer cylinder part
12 Sprocket
19 Cam bolt
20 Inner cylinder part
26 Bearing
27 Stopper
28 C ring
30 Intermediate member
42 Electromagnetic clutch
44 Rotational drum
45 Magnet
51 Stopper
52 Bearing
53 Sliding bearing
54,55 Bearing
102 Controller
104 Coil drive circuit
108 Magnetic sensor
120 Coil
122 Iron core

The invention claimed is:

1. A phase varying apparatus for use with an engine, the phase varying apparatus comprising:

an outer cylinder part to which rotations of a crankshaft of the engine are transmitted;

an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner;

relative rotations being generated between the outer cylinder part and the inner cylinder part by moving the intermediate member in an axial direction, thereby changing an opening/closing timing of the intake valve or the exhaust valve;

wherein the improvement comprises:

a rotational drum screwed to the intermediate member;

a plurality of magnets fixed to the rotational drum with predetermined intervals in a circumferential direction of the rotational drum;

an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine;

wherein a first bearing and a stopper arranged in parallel with each other are fixed to an outer periphery of the inner cylinder part, wherein the rotational drum is rotatably supported by the first bearing, wherein a second bearing fixed to an outer periphery of the stopper is connected to the electromagnetic clutch, and wherein the electromagnetic clutch is attached to a cover, and is supported by the cover in a rotationally stopped manner.

2. A phase varying apparatus for use with an engine, the phase varying apparatus comprising:

an outer cylinder part to which rotations of a crankshaft of the engine are transmitted;

an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner;

relative rotations being generated between the outer cylinder part and the inner cylinder part by moving the intermediate member in an axial direction, thereby changing an opening/closing timing of the intake valve or the exhaust valve;

wherein the improvement comprises:

a rotational drum screwed to the intermediate member;

a plurality of magnets fixed to the rotational drum with predetermined intervals in a circumferential direction of the rotational drum;

an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine;

wherein a first bearing is fixed to an outer periphery of the inner cylinder part, wherein the rotational drum is rotatably supported by the first bearing, wherein an annular boss with which the intermediate member is covered is connected to the outer cylinder part, wherein the annular boss is connected to the electromagnetic clutch through a second bearing, and wherein the electromagnetic clutch is attached to a cover, and is supported by the cover in a rotationally stopped manner.

3. A phase varying apparatus for use with an engine, the phase varying apparatus comprising:

an outer cylinder part to which rotations of a crankshaft of the engine are transmitted;

an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner;

relative rotations being generated between the outer cylinder part and the inner cylinder part by moving the intermediate member in an axial direction, thereby changing an opening/closing timing of the intake valve or the exhaust valve;

wherein the improvement comprises:

a rotational drum screwed to the intermediate member;

a plurality of magnets fixed to the rotational drum with predetermined intervals in a circumferential direction of the rotational drum;

an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine;

wherein a first bearing is fixed to an outer periphery of the inner cylinder part, wherein the rotational drum is rotatably supported by the first bearing, wherein a second bearing disposed between the electromagnetic clutch and the rotational drum for preventing the electromagnetic clutch from moving in an axial direction of the inner cylinder part is attached to an outer periphery of the rotational drum, wherein the second bearing is attached to the electromagnetic clutch and is supported by the electromagnetic clutch in a rotationally stopped manner, wherein the electromagnetic clutch is attached to a cover and is supported by the cover in a rotationally stopped manner, a boss is formed on the cover with which the electromagnetic clutch is covered, a first annular groove is formed in an outer circumferential surface of the boss of the cover, an elastic body at least a part of which protrudes from the first annular groove and which has elasticity in a circumferential direction of the first annular groove is fitted to the first annular groove, a second annular groove facing the first annular groove is formed in a surface of the electromagnetic clutch facing the boss, and the electromagnetic clutch attached to the boss of the cover is prevented from moving in a direction perpendicular to a radial direction of the boss owing to contact with the elastic body disposed over the first annular groove and the second annular groove.

4. A phase varying apparatus for use with an engine, the phase varying apparatus comprising:

an outer cylinder part to which rotations of a crankshaft of the engine are transmitted;

an inner cylinder part that is rotatable relative to the outer cylinder part and that is connected to a camshaft used to open and close an intake valve or an exhaust valve of the engine; and an intermediate member engaged with the outer cylinder part and with the inner cylinder part in a helical spline manner;

relative rotations being generated between the outer cylinder part and the inner cylinder part by moving the intermediate member in an axial direction, thereby changing an opening/closing timing of the intake valve or the exhaust valve;

wherein the improvement comprises:

a rotational drum screwed to the intermediate member;

a plurality of magnets fixed to the rotational drum with predetermined intervals in a circumferential direction of the rotational drum;

an electromagnetic clutch having an iron core and a single or a plurality of coils wound on the iron core, the iron core provided with a plurality of magnetic parts, the magnetic parts exerting a magnetic force on the magnets and being arranged with predetermined intervals in the circumferential direction; and an electromagnetic force control means for controlling an electromagnetic force generated from the electromagnetic clutch in accordance with an operational state of the engine;

wherein a first bearing and a second bearing arranged in parallel with each other are fixed to an outer periphery of the inner cylinder part, wherein the rotational drum is rotatably supported by the first bearing, wherein the second bearing is held by a cover with which the electromagnetic clutch is covered, wherein the electromagnetic clutch is attached to the cover, and is supported by the cover in a rotationally stopped manner, a boss is formed on the cover with which the electromagnetic clutch is covered, a first annular groove is formed in an outer circumferential surface of the boss of the cover, an elastic body at least a part of which protrudes from the first annular groove and which has elasticity in a circumferential direction of the first annular groove is fitted to the first annular groove, a second annular groove facing the first annular groove is formed in a surface of the electromagnetic clutch facing the boss, and the electromagnetic clutch attached to the boss of the cover is prevented from moving in a direction perpendicular to a radial direction of the boss owing to contact with the elastic body disposed over the first annular groove and the second annular groove.

* * * * *